US011008707B2

(12) United States Patent
Yoda et al.

(10) Patent No.: US 11,008,707 B2
(45) Date of Patent: May 18, 2021

(54) SHEET MANUFACTURING APPARATUS, SHEET MANUFACTURING SYSTEM, CONTROL METHOD OF A SHEET MANUFACTURING APPARATUS, AND SHEET MANUFACTURING METHOD

(71) Applicant: SEIKO EPSON CORPORATION, Tokyo (JP)

(72) Inventors: Kaneo Yoda, Okaya (JP); Yoshiyuki Nagai, Shiojiri (JP); Yuki Oguchi, Okaya (JP); Shigeo Fujita, Matsumoto (JP); Akira Arai, Suwa-gun (JP); Kazuhiro Ichikawa, Okaya (JP); Teruaki Oguchi, Suwa (JP); Seiichi Taniguchi, Higashichikuma-gun (JP)

(73) Assignee: SEIKO EPSON CORPORATION, Tokyo (JP)

( * ) Notice: Subject to any disclaimer, the term of this patent is extended or adjusted under 35 U.S.C. 154(b) by 201 days.

(21) Appl. No.: 16/117,538

(22) Filed: Aug. 30, 2018

(65) Prior Publication Data

US 2019/0062996 A1 Feb. 28, 2019

(30) Foreign Application Priority Data

Aug. 31, 2017 (JP) ..... JP2017-166556

(51) Int. Cl.
*D21F 7/00* (2006.01)
*D21F 9/04* (2006.01)
(Continued)

(52) U.S. Cl.
CPC ..... *D21F 9/046* (2013.01); *B27N 3/00* (2013.01); *D04H 1/60* (2013.01); *D21F 5/00* (2013.01);
(Continued)

(58) Field of Classification Search
USPC ..... 162/183
See application file for complete search history.

(56) References Cited

U.S. PATENT DOCUMENTS 5,931,927 A 8/1999 Takashima
6,868,623 B2 3/2005 Bjornberg
(Continued)

FOREIGN PATENT DOCUMENTS

CN 1505721 A 6/2004
CN 107109741 A 8/2017
(Continued)

OTHER PUBLICATIONS

Feb. 1, 2019 extended Search Report issued in European Patent Application No. 18191619.8.

*Primary Examiner* — Mark Halpern
(74) *Attorney, Agent, or Firm* — Oliff PLC

(57) ABSTRACT

Provided is technology improving the efficiency (productivity) of a sheet manufacturing apparatus. A sheet manufacturing apparatus 100 manufactures sheets S by heating with heaters 81 and 82 a mixture (second web W2) of resin and fiber produced by defibrating feedstock MA. The heaters 81 and 82 each have a first roller 171, a second roller 172 that holds the second web W2 with the first roller 171, and a moving mechanism 190. The moving mechanism 190 can switch the first roller 171 and second roller 172 to a position holding the second web W2, and a first roller 171 and second roller 172 are separated and do not hold the second web W2. The heaters 81 and 82 are configured as units that can removably installed to the sheet manufacturing apparatus 100.

11 Claims, 17 Drawing Sheets

(51) Int. Cl.

| | |
|---|---|
| ***D21H 21/06*** | (2006.01) |
| ***D21F 11/06*** | (2006.01) |
| ***B27N 3/00*** | (2006.01) |
| ***D21F 5/00*** | (2006.01) |
| ***D21F 9/00*** | (2006.01) |
| ***D04H 1/60*** | (2006.01) |

(52) U.S. Cl.
CPC ..... *D21F 7/00* (2013.01); *D21F 9/00* (2013.01); *D21F 11/06* (2013.01); *D21H 21/06* (2013.01)

(56) References Cited

U.S. PATENT DOCUMENTS

| | | | | |
|---|---|---|---|---|
| 2004/0128856 | A1 | 7/2004 | Bjornberg | |
| 2015/0240418 | A1 | 8/2015 | Oguchi | |
| 2016/0229093 | A1 | 8/2016 | Gomi | |
| 2016/0230320 | A1 | 8/2016 | Ueno et al. | |
| 2016/0332325 | A1 | 11/2016 | Murayama et al. | |
| 2017/0114484 | A1* | 4/2017 | Tsujino | B27N 3/00 |
| 2018/0237992 | A1 | 8/2018 | Nagai et al. | |

FOREIGN PATENT DOCUMENTS

| | | | |
|---|---|---|---|
| EP | 3 133 197 | A1 | 2/2017 |
| EP | 3 246 446 | A1 | 11/2017 |
| JP | H11-188830 | A | 7/1999 |
| JP | 2012-167414 | A | 9/2012 |
| JP | 2013-87368 | A | 5/2013 |
| JP | 2015-92032 | A | 5/2015 |
| JP | 2015-155180 | A | 8/2015 |
| JP | 2015-161035 | A | 9/2015 |
| JP | 2016-130009 | A | 7/2016 |
| TW | 317659 | B | 10/1997 |
| TW | 201516207 | A | 5/2015 |

* cited by examiner

| JOB NUMBER | JOB1 | JOB2 | JOB3 | JOB4 | JOB5 |
|---|---|---|---|---|---|
| OPERATING TEMPERATURE | a11 | a12 | a13 | a14 | a15 |
| OPERATING TIME | a21 | a22 | a23 | a24 | a25 |
| TOTAL | a31 | a32 | a33 | a34 | a35 |

SHEET MANUFACTURING APPARATUS, SHEET MANUFACTURING SYSTEM, CONTROL METHOD OF A SHEET MANUFACTURING APPARATUS, AND SHEET MANUFACTURING METHOD

BACKGROUND

1. Technical Field

The present invention relates to a sheet manufacturing apparatus useful for manufacturing paper (sheets), a sheet manufacturing system having the sheet manufacturing apparatus, control method of the sheet manufacturing apparatus, and a sheet manufacturing method.

2. Related Art

JP-A-2016-130009 and JP-A-2015-161035 describe dry process sheet manufacturing apparatuses having a forming unit that forms sheets by applying heat and pressure to material containing fiber and resin (binder), and produces paper (sheets) using extremely small amounts of water.

For example, the sheet manufacturing apparatus described in JP-A-2016-130009 holds the material between a first roller and a second roller, and compresses and heats the material to make a sheet. The first roller has a core that is located in the center of the roller and coated with a soft body (rubber), and the outside (surface) of the soft body is heated by a heater. The second roller has a core that has a heat source inside and is not coated by a soft body. In other words, there is a difference in the hardness of the first roller and second roller, the soft body of the first roller deforms following unevenness in the surface of the material, thereby increasing the contact area when the material is held and enabling efficiently heating the material. In addition, because only the surface of the soft body is heated by the heater, thermal degradation of the soft body is inhibited compared with a configuration that heats the soft body throughout.

In the sheet manufacturing apparatus described in JP-A-2015-161035, a compression unit and a heating unit are disposed to the forming unit, and the thickness and density of the sheet can be varied by adjusting at least one of the pressure of the compression unit and the temperature of the heating unit. In other words, the sheet manufacturing apparatus described in JP-A-2015-161035 has a single heating and compression device, and varies the thickness and density of the sheet by changing the operating conditions of the heating and compression device.

However, because the soft body of the sheet manufacturing apparatus described in JP-A-2016-130009 is heated, thermal degradation of the soft body is inevitable, and part replacement becomes necessary. When part replacement becomes necessary due to thermal degradation of the soft body, the system must be shut down for a relatively long time to replace the part, and system efficiency (productivity) drops. A configuration not having a soft body is conceivable, but when the material is held between the first roller and second roller in a configuration not having a soft body, unevenness in the material is flattened, producing glossiness in spots and making it difficult to produce sheets with a uniformly matte surface.

When the operating conditions of the heating and compression device are changed in the sheet manufacturing apparatus described in JP-A-2015-161035, system efficiency (productivity) drops because sheets cannot be manufactured while the conditions of the heating and compression device are being changed. In addition, the service life of the heating and compression device (particularly the heater) is shortened, and when parts replacement or other maintenance become necessary, the system must be shut down for a relatively long time to replace the part, and system efficiency (productivity) drops.

There is also a need to increase the rate of production in the sheet manufacturing apparatus by heating the material more quickly and manufacturing sheets more quickly.

SUMMARY

The present invention is directed to solving at least part of the foregoing problem, and can be achieved by the embodiments or examples described below.

Example 1

In a sheet manufacturing apparatus configured to make a sheet by heating, by a heater, a mixture of a binder and fiber produced by defibrating feedstock, according to a first aspect of the invention, the heater is a discrete unit that can be removably installed to the sheet manufacturing apparatus.

The heater in this configuration is an integrated unit that is removably installable to the sheet manufacturing apparatus, and the heater unit can be installed and removed (replaced) as a single assembly to the sheet manufacturing apparatus. When the sheet manufacturing apparatus becomes unusable because the heater reached the end of its service life or a problem occurred, the heater (heater unit) that cannot be used can be replaced with a functioning heater (heater unit), and the sheet manufacturing apparatus can be quickly restoring to working condition.

If the heater is not configured as a unit, and the sheet manufacturing apparatus is restored by disassembling the heater and replacing the unusable part, disassembling and reassembling the heater may take a long time, and the operation of the sheet manufacturing apparatus may stop for a long time.

However, if a spare housing unit according to this configuration is kept in stock, the sheet manufacturing apparatus can be restored to working order by replacing the unusable heater with a usable heater without disassembling the heater, sheet manufacturing apparatus down time is therefore short compared disassembling the heater and replacing unusable parts, and the efficiency (productivity) of the sheet manufacturing apparatus can be improved.

Example 2

Preferably in the sheet manufacturing apparatus described above, the heater is configured with a first roller, a second roller disposed to hold the mixture between the first roller and second roller, and a moving mechanism configured to switch between a position holding the mixture between the first roller and second roller, and a position where the first roller and second roller are separated and not holding the mixture therebetween.

In this configuration, the components of the heater (first roller, second roller, moving mechanism) are configured as an integrated unit that is removably installable to the sheet manufacturing apparatus, and the heater unit can be installed and removed (replaced) as a single assembly to the sheet manufacturing apparatus. When the sheet manufacturing apparatus becomes unusable because the heater reached the end of its service life or a problem occurred, the heater (heater unit) that cannot be used can be replaced with a functioning heater (heater unit), and the sheet manufacturing apparatus can be quickly restoring to working condition.

In addition, the moving mechanism setting the first roller and second roller to the position holding the mixture sets the heater to the heating position heating the mixture. When the moving mechanism sets the first roller and second roller to the separated position not holding the mixture, the heater is set to a non-heating position not heating the mixture. Whether the heater is in the heating position heating the mixture, or the non-heating position not heating the mixture, can therefore be selected.

Example 3

Preferably in the sheet manufacturing apparatus described above, the heater configured as a removably installable unit includes a first heater, and a second heater configured to heat the mixture under a different condition than the first heater.

When the heating conditions of the mixture change due to a change in the type of mixture, for example, and the heater can only be set to one type of heating condition, sheet production must be stopped to change the operating conditions of the heater. This creates a loss from being unable to produce sheets while changing the operating parameters of the heater.

This configuration enables setting two different conditions using the first heater, and using the second heater, which heats the mixture under different conditions than the first heater. In addition, the moving mechanism can switch between heating the mixture by the first heater, or heating the mixture by the second heater. For example, if the conditions of the second heater are changed while producing a sheet by heating the mixture with the first heater, sheet production can continue with the first heater while changing the conditions of the second heater. This reduces loss from being unable to produce sheets while changing the operating parameters of the heater, and can improve the efficiency (productivity) of the sheet manufacturing apparatus.

Example 4

Preferably in the sheet manufacturing apparatus described above, the different condition is a heating condition of the mixture, a compression condition of the mixture, or a material of the first roller or the second roller.

If the compression condition of the mixture, or a material of the first roller or the second roller, can be made to change by switching between the first heater and second heater, loss from being unable to produce sheets while changing the operating parameters of the heater can be further reduced, and the mixture can be heated and sheets manufactured under the optimum conditions.

Example 5

Another aspect of the invention is a sheet manufacturing apparatus configured to make a sheet by heating, by a heater, a mixture of a binder and fiber produced by defibrating feedstock, wherein: the heater includes a first heater, and a second heater configured to heat the mixture under a different condition than the first heater.

This configuration enables setting two different conditions using the first heater and the second heater. If the conditions of the second heater are changed while producing a sheet by heating the mixture with the first heater, sheet production can continue with the first heater while changing the conditions of the second heater. This reduces loss from being unable to produce sheets while changing the operating parameters of the heater, and can improve the efficiency (productivity) of the sheet manufacturing apparatus.

Example 6

Preferably in the sheet manufacturing apparatus described above, the different condition is a heating condition of the mixture, a compression condition of the mixture, or a quality or texture of the manufactured sheet.

If the compression condition of the mixture, or a quality or texture of the manufactured sheet, can be made to change by switching between the first heater and second heater, loss from being unable to produce sheets while changing the operating parameters of the heater can be further reduced, and the mixture can be heated and sheets manufactured under the optimum conditions.

Example 7

Preferably, the sheet manufacturing apparatus described above, also has a first path where the mixture is heated by the first heater while being conveyed; and a second path where the mixture is heated by the second heater while being conveyed; and the first path and second path are selectable.

This configuration enables changing between using the first path to heat the mixture with the first heater and make sheets, and using the second path to heat the mixture with the second heater and make sheets.

For example, if the conditions of the second heater are changed while producing a sheet using the first path to heat the mixture with the first heater, sheet production can continue using the first path to heat the mixture with the first heater while changing the conditions of the second heater. This reduces loss from being unable to produce sheets while changing the operating parameters of the heater, and can improve the efficiency (productivity) of the sheet manufacturing apparatus.

Example 8

Preferably in the sheet manufacturing apparatus described above, the first heater and second heater are disposed in the direction the mixture is conveyed; and the mixture is heated by at least one of the first heater and second heater.

This configuration enables setting two different conditions using the first heater and the second heater. If the conditions of the second heater are changed while producing a sheet by heating the mixture with the first heater, sheet production can continue with the first heater while changing the conditions of the second heater. This reduces loss from being unable to produce sheets while changing the operating parameters of the heater, and can improve the efficiency (productivity) of the sheet manufacturing apparatus.

Furthermore, if both the first heater and second heater are used to heat the mixture, the mixture can be heated more quickly than when the mixture is heated by only the first heater or the second heater, and sheets can be quickly manufactured. More specifically, sheet production in the sheet manufacturing apparatus can be accelerated.

Example 9

Preferably in the sheet manufacturing apparatus described above, the heater has a first storage that readably stores first information.

By disposing a first storage enabling reading first information to the heater, and information related to the heater is stored in the first storage as first information, the condition of the heater can be known in detail.

Example 10

Preferably in the sheet manufacturing apparatus described above, the first information includes a cumulative total of sequentially added products of an operating time of the heater and an operating temperature of the heater; and the cumulative total includes a warning value warning a state in which the heater cannot be used appropriately is approaching, and a usable limit value, which is a maximum value at which the heater can be used appropriately.

Evaluating deterioration of the heater using only the operating time of the heater or the operating temperature of the heater is difficult, but the deterioration of the heater can be evaluated based on the cumulative total of sequentially added products of the operating time of the heater and the operating temperature of the heater.

In addition, if the cumulative total includes a warning value for warning the operator of a state in which the heater cannot be used appropriately is approaching, when the heater will become unusable (the end of the service life of the heater) can be predicted based on the warning value. Furthermore, if the cumulative total also includes a usable limit value, which is a maximum value at which the heater can be used appropriately, when the heater will become unusable can be accurately determined from the usable limit value.

Example 11

Preferably, the sheet manufacturing apparatus described above also has a binder supply device individually storing different types of binders; and a second storage disposed to the binder supply device and storing second information readably; the second information including at least one of the type of binder, and a heating temperature linked to the type of binder.

Because second information (the type of binder, and a heating temperature linked to the type of binder) for setting the heating conditions of the mixture are readably stored in the second storage disposed to the binder supply device, the heating conditions of the heater can be set.

Example 12

Preferably, the sheet manufacturing apparatus described above, also has a controller, the controller calculating a new product each time the heater operates, calculating a new total adding the new product to the previous total, storing the new total in the first storage, and when the new total exceeds the warning value, prompting replacement of the heater.

The controller calculates a new product each time the heater operates, calculates a new total adding the new product to the previous total, and when the new total exceeds the warning value, prompts replacement of the heater. More specifically, the controller prompts installing a new heater based on the new total and warning value before the heater becomes effectively unusable. In other words, the controller estimates the service life of the heater, and enables installing a new heater before the heater reaches the end of its service life.

When the heater reaches its service life, the apparatus must stop, and the expended heater must be replaced with a new heater. Production therefore stops to install a new heater. If a new heater is acquired after the heater reaches its service life, and a spare heater is not in stock, acquiring a new heater may take a long time, and the time the apparatus is stopped to install a new heater may be long. However, if the service life of the heater is predicted and a new heater is made ready before the heater reaches the end of its service life, even if a spare new heater is not kept in stock, a new heater can be readied before the heater reaches the end of its service life, and the length of time the apparatus is stopped to install a new heater can be shortened.

Therefore, compared with when a new heater is readied after the service life of the heater is reached, predicting the end of the service life of the heater and reading a new heater before the end of the service life of the heater is reached reduces loss from the down time of the sheet manufacturing apparatus, and can improve the efficiency (productivity) of the sheet manufacturing apparatus.

Example 13

Preferably, the sheet manufacturing apparatus described above also has a controller, the controller calculating a new product each time the heater operates, calculating a new total adding the new product to the previous total, storing the new total in the first storage, and when the new total exceeds the warning value, turning the heater off.

The controller calculates a new product each time the heater operates, calculates a new total adding the new product to the previous total, and when the new total exceeds the warning value, turns the heater off. More specifically, when the heater cannot be used appropriately, the controller automatically disables using the heater. Problems arising from heating the mixture with a heater that cannot heat correctly can therefore be reliably suppressed.

Example 14

Preferably, a the sheet manufacturing apparatus described above also has a controller, the controller determining the heating temperature of the heater based on the first information, the second information, and input information including the type of feedstock, the type of sheet, and the sheet production speed, and heating the mixture using the first heater, or the second heater, or the first heater and second heater.

Based on the first information, the second information, and input information including the type of feedstock, the type of sheet, and the sheet production speed, the controller determines the heating temperature of the heater, and selects from among multiple heaters (first heater, second heater) the heater best suited to heating the mixture. More specifically, the heater best suited to heating the mixture is automatically selected from among multiple heaters.

Example 15

Another aspect of the invention is a sheet manufacturing system including the sheet manufacturing apparatus described above, and a heater configured as a unit removably installable to the sheet manufacturing apparatus.

Using a heater that does not completely flatten the surface texture of the material is preferable when making a sheet with a dull, matte finish from material having a textured surface that is not easily flattened. When making a sheet with a shiny, glossy finish, a heater that can easily flatten unevenness in the surface of the material is preferable. The desirable configuration of the heater therefore differs according to the quality and texture of the sheet being made.

By configuring the sheet manufacturing system with heaters suitable for making sheets of different quality and texture, the quality and texture of the sheets that are produced can be improved, and a wide variety of sheets can be made, by changing to the heater preferred for making sheets of different quality and texture. In addition, because the heater is removably installed to the sheet manufacturing apparatus, the down time of the sheet manufacturing apparatus required to exchange a heater is shorter than when the sheet manufacturing apparatus must be disassembled to replace the heater, and the efficiency (productivity) of the sheet manufacturing apparatus can be improved.

Example 16

Another aspect of the invention is a control method of a sheet manufacturing apparatus having a heater configured to heat a mixture of a binder and fiber produced by defibrating feedstock, first storage disposed to the heater and readably storing first information, and a controller, and heating the mixture by the heater to make a sheet, wherein: the first information includes a cumulative total of sequentially added products of an operating time of the heater and an operating temperature of the heater, and the cumulative total includes a warning value warning a state in which the heater cannot be used appropriately is approaching; and the controller, when the exceeds the warning value, prompts replacement of the heater.

The controller calculates a new product each time the heater operates, calculates a new total adding the new product to the previous total, and when the new total exceeds the warning value, prompts replacement of the heater. More specifically, the controller prompts installing a new heater based on the new total and warning value before the heater becomes effectively unusable. In other words, the controller estimates the service life of the heater, and enables installing a new heater before the heater reaches the end of its service life.

If the service life of the heater is predicted and a new heater is made ready before the heater reaches the end of its service life, even if a spare new heater is not kept in stock, a new heater can be readied before the heater reaches the end of its service life, and the length of time the apparatus is stopped to install a new heater can be shortened.

Example 17

Another aspect of the invention is a control method of a sheet manufacturing apparatus having multiple heaters configured to heat a mixture of a binder and fiber produced by defibrating feedstock, first storage disposed to the heater and readably storing first information, a binder supply device individually storing different types of binders, a second storage disposed to the binder supply device and storing second information readably, and a controller, and heating the mixture by the heater to make a sheet, wherein: the first information includes a cumulative total of sequentially added products of an operating time of the heater and an operating temperature of the heater, and the cumulative total includes a warning value warning a state in which the heater cannot be used appropriately is approaching; and the second information includes at least one of the type of binder, and a heating temperature linked to the type of binder; the controller selecting, from the multiple heaters, based on the first information, the second information, and input information including the type of feedstock, the type of sheet, and the sheet production speed, the heater appropriate to heat the mixture.

Based on the first information, the second information, and input information, the controller determines the heating temperature of the heater, and automatically selects from among multiple heaters the heater best suited to heating the mixture. The heater best suited to heating the mixture can therefore be reliably selected.

Example 18

Another aspect of the invention is a sheet manufacturing method configured to make a sheet by heating, by a heater disposed to an apparatus, a mixture of a binder and fiber produced by defibrating feedstock, including: electrically disconnecting and mechanically disengaging in the apparatus a first heater cassette removably installed to the apparatus as a heater; electrically connecting and mechanically engaging in the apparatus a second heater cassette in place of the first heater cassette; and heating the mixture by the second heater installed in the apparatus.

A sheet manufacturing method according to this configuration enables installing a second heater cassette in place of a first heater cassette. Therefore, when there is a problem with the first heater cassette and the apparatus cannot be operated, the apparatus can be restored to normal operation by installing the second heater cassette in place of the first heater cassette. For example, when making a sheet that is difficult to make when heating with the first heater cassette, the sheet can be desirably produced by replacing the first heater cassette with the second heater cassette.

Example 19

Preferably in the sheet manufacturing method described above, specifications of the first heater cassette and second heater cassette differ by one of a heating condition of the mixture, a compression condition of the mixture, or a quality or texture of the manufactured sheet; the apparatus enables selectively setting at least one of the type of feedstock, the type of sheet, and the sheet production speed as input information; and the step of removing the first heater cassette from the apparatus, and the step of installing the second heater cassette in the apparatus in place of the first heater cassette, executes according to a setting of the input information in the apparatus.

The specifications of the first heater cassette and second heater cassette differ by one of a heating condition of the mixture, a compression condition of the mixture, or a quality or texture of the manufactured sheet. More specifically, different kinds of sheets can be made by using the first heater cassette and second heater cassette.

Because the sheet manufacturing method according to this example enables selecting whether to install the first heater cassette to the apparatus and make sheets with the first heater cassette, or install the second heater cassette to the apparatus and make sheets with the second heater cassette, a wide variety of sheets can be manufactured. For example, a variety of sheets with different quality and texture can be made.

Other objects and attainments together with a fuller understanding of the invention will become apparent and appreciated by referring to the following description and claims taken in conjunction with the accompanying drawings.

DESCRIPTION OF EMBODIMENTS

Embodiments of the invention are described below with reference to the accompanying figures. These embodiments describe desirable embodiments of the invention, do not limit the invention, and can be varied as desired within the technical scope of the invention. Furthermore, in the accompanying figures, layers and parts are sized to enable recognition thereof in the figures, and the scale of the layers and parts differs from the actual scale.

Embodiment 1

Outline of a Sheet Manufacturing Apparatus

Figure 1:
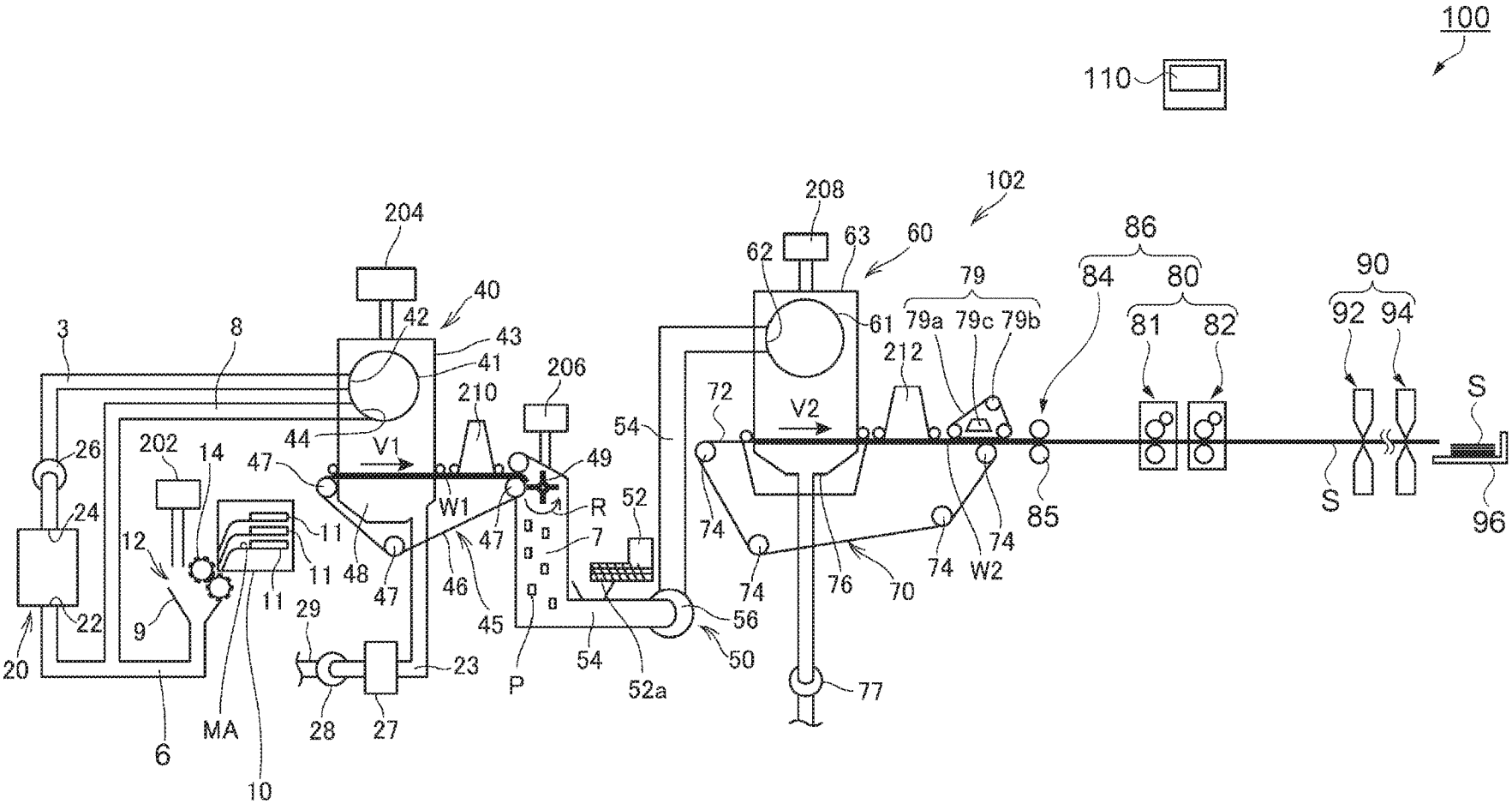
FIG. 1 schematically illustrates the configuration of a sheet manufacturing apparatus according to a first embodiment of the invention.
Figure 2:
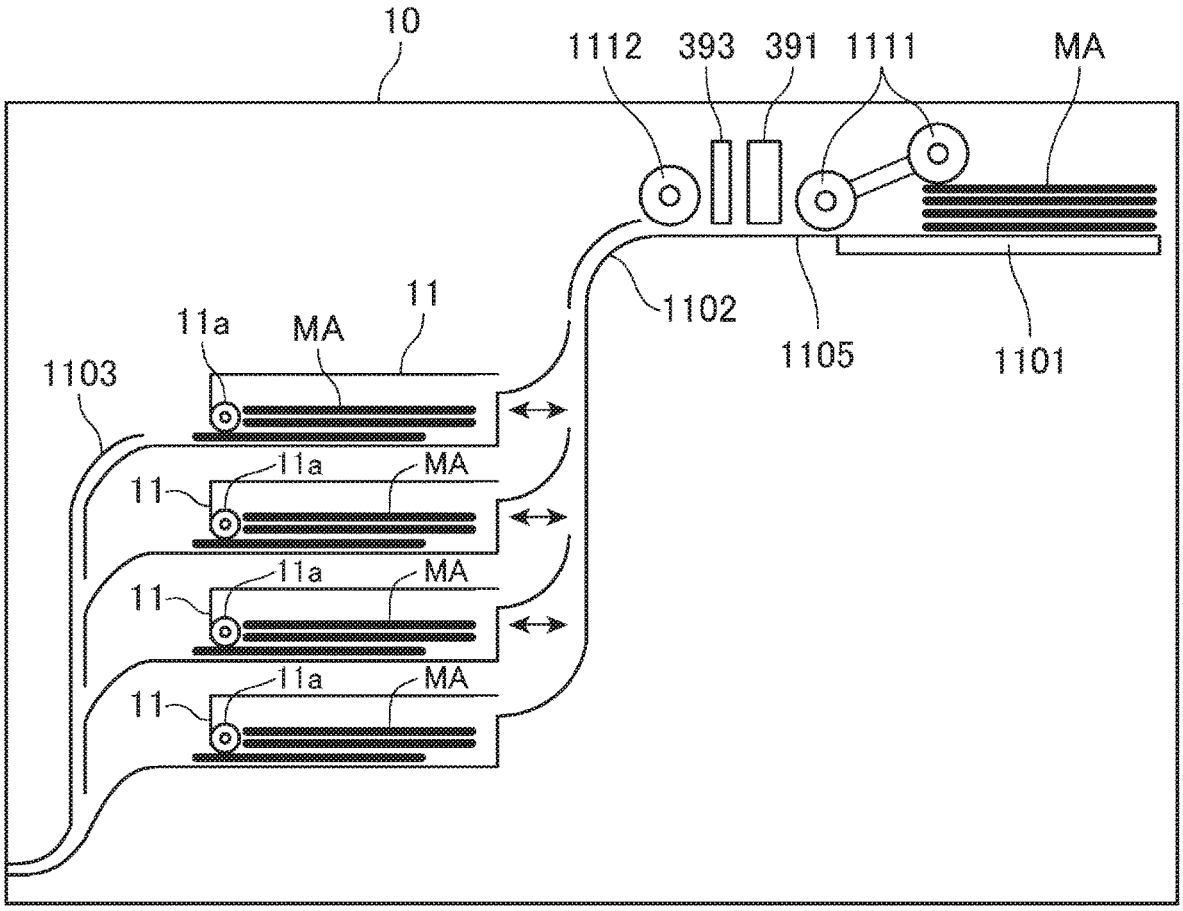
FIG. 2 illustrates the configuration of the supply device.
Figure 3:
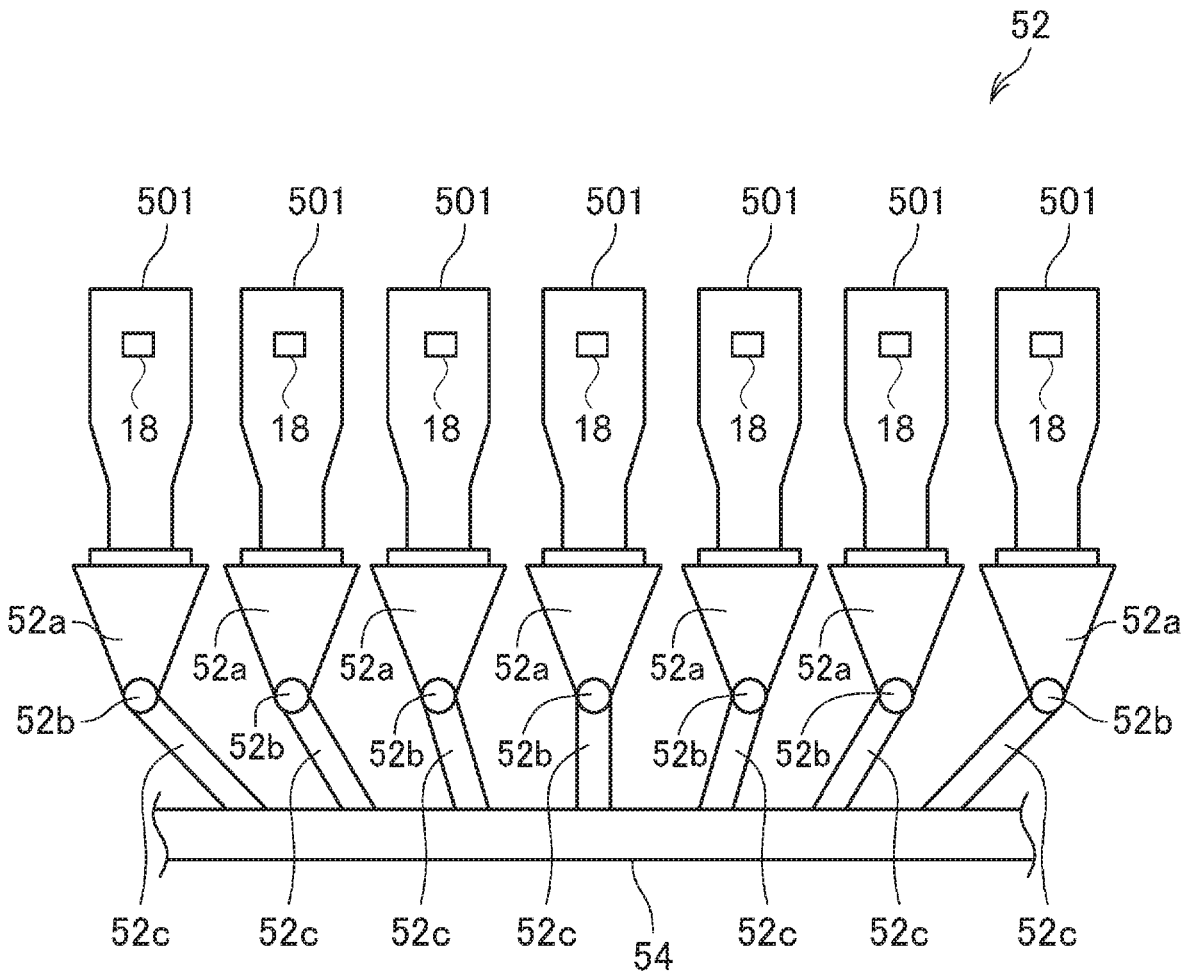
FIG. 3 illustrates the conventional of the additive supplier.

FIG. 1 schematically illustrates the configuration of a sheet manufacturing apparatus according to a first embodiment of the invention. FIG. 2 illustrates the configuration of the supply device. FIG. 3 illustrates the conventional of the additive supplier.

A sheet manufacturing apparatus 100 according to this embodiment of the invention is described first with reference to FIG. 1 to FIG. 3.

The sheet manufacturing apparatus 100 according to this embodiment is convenient for defibrating feedstock MA such as confidential documents and other recovered paper in a dry process into loose fibers, and then producing new paper (sheet S) by through compression, heating, and cutting operations. By mixing various additives with the defibrated feedstock MA, the strength and whiteness of the paper product can be improved according to the application, and other desirable properties such as color, scent, and flame retardancy can be imparted. Furthermore, by controlling the density, thickness, and shape of the formed paper, paper of various thicknesses and sizes, including paper for business cards, and A4, A3, and other standard sizes of office paper, can be manufactured according to the intended application.

The sheet manufacturing apparatus 100 has a manufacturing unit 102 and a control device 110. The manufacturing unit 102 manufactures a sheet S, and the control device 110 (controller 120, (see FIG. 8)) controls parts of the manufacturing unit 102.

The manufacturing unit 102 has, disposed sequentially along the direction in which the sheet S material moves, a supply device 10, shredder 12, defibrator 20, screener 40, first web forming device 45, rotor 49, mixing device 50, air-laying device 60, second web forming device 70, conveyor 79, sheet forming unit 86, and cutting device 90.

As described in further detail below, the sheet manufacturing apparatus 100 manufactures a sheet S by heating, by means of a heater group 80 (heaters 81 and 82), a mixture (second web W2) of fiber produced by defibrating feedstock MA and a binder (resin).

The sheet manufacturing apparatus 100 also has wetting devices 202, 204, 206, 208, 210, 212 for wetting the feedstock MA and defibrated material. The wetting devices 202, 204, 206, 208, 210, 212 humidify the feedstock MA and defibrated material directly and/or the spaces through which they travel. The specific configuration of the wetting devices 202, 204, 206, 208, 210, 212 may be designed as desired, and steam, evaporative, warm air vaporization, ultrasonic, or other type of humidification method may be used.

The supply device 10 has multiple stackers 11 (storage units) that hold feedstock MA. Recovered paper, which is the feedstock MA in this example, is stored in a stack in each stacker 11. The supply device 10 supplies feedstock MA from one of the multiple stackers 11 to the shredder 12.

The feedstock MA is material containing fiber, and may be, for example, paper), may be pulp, pulp sheets, cloth, including nonwoven cloth, or textiles, for example. Recovered paper is used as the feedstock MA in this example. Recovered paper is paper that has been printed or written on used at least once, and typically has toner or ink on it.

As shown in FIG. 2, the supply device 10 includes a table 1101 on which feedstock MA is stacked, a pair of supply rollers 1111 that feed the feedstock MA from the stack on the table 1101, a supply roller 1112 that conveys the feedstock MA, and multiple stackers 11 in which the feedstock MA is stored.

The supply rollers 1111 pick and feed the feedstock MA one sheet at a time to a detection conveyance path 1105. Disposed to the detection conveyance path 1105 are a color meter 391 and scanner 393.

The color meter 391 is disposed facing the detection conveyance path 1105, measures the color of the surface of the feedstock MA, and outputs the result to the control device 110.

The scanner 393 is also disposed facing the detection conveyance path 1105. The scanner 393 comprises a light source (not shown in the figure) that emits light to the detection conveyance path 1105, and a line sensor such as a CCD (Charge Coupled Device) sensor or CMOS (Complementary Metal Oxide Semiconductor) sensor that detects light reflected from the feedstock MA, and outputs the image read by the line sensor to the control device 110.

The feedstock MA is conveyed by the supply roller 1112 from the detection conveyance path 1105 to a conveyance path 1102, and stored in a stacker 11.

In this embodiment of the invention there are four stackers 11 disposed slidably in the directions indicated by the arrows. Each stacker 11 moves from a position separated from the conveyance path 1102 to a position near or touching the conveyance path 1102, and stores the feedstock MA conveyed through the conveyance path 1102. Each stacker 11 has a feed roller 11*a* that feeds feedstock MA stored in the stacker 11. Feedstock MA stored in a stacker 11 is fed one sheet at a time by the feed roller 11*a* to a supply path 1103 through which it is conveyed to the shredder 12.

While conveying feedstock MA in the supply device 10, the color meter 391 measures the color of the feedstock MA, and the scanner 393 reads the feedstock MA.

The control device 110 acquires the color measurement from the color meter 391, and the image captured by the scanner 393. The control device 110 determines the color of the surface of the feedstock MA based on the output of the color meter 391, and identifies the type of feedstock MA. The type of feedstock MA in this example is PPC (plain paper copy) paper, kraft paper, or recycled paper. In addition, the control device 110, based on the result from the color meter 391, determines the degree of whiteness of the non-printed areas where there is no toner or ink, for example, estimates whether there is bleaching, and determines if the feedstock MA is kraft paper. The control device 110 also detects, from the result of the color meter 391 and the image captured by the scanner 393, the amount and type (ink, toner, resin toner) of color material fixed on the feedstock MA, and the area of the surface of the feedstock MA covered by the color material.

The control device 110 identifies the type of feedstock MA, moves the stacker 11 corresponding to the type of detected feedstock MA to the conveyance path 1102 side, and stores the feedstock MA in stackers 11 that differ according to the type of feedstock MA. More specifically, a single type of feedstock MA is stored in each stacker 11. As a result, feedstock MA of a particular type can be selected by selecting the appropriate stacker 11.

Referring again to FIG. 1, the shredder 12 cuts (shreds) the feedstock MA supplied from the supply device 10 with shredder blades 14 into coarse shreds. The shredder 12 in this example has the configuration of a common paper shredder with a pair of shredder blades 14 that shred the feedstock MA held therebetween, and a drive mechanism that turns the shredder blades 14. The shredder 12 in this example cuts the feedstock MA into shreds of approximately one to several centimeters square.

The shredder 12 also has a chute (hopper) 9 that receives the paper shreds cut by and falling from the shredder blades 14. The chute 9 connects to the defibrator 20 through a conduit 6. The shreds are collected by the chute 9 and conveyed through the conduit 6 to the defibrator 20.

The defibrator 20 defibrates the shreds produced by the shredder 12. More specifically, the defibrator 20 breaks the shreds produced by the shredder 12 into individual detangled fibers, producing defibrated material. The defibrator 20 also functions to separate resin particles, ink, toner, bleeding inhibitors, and other material affixed to feedstock from the fibers.

The material that passes through the defibrator 20 is referred to as defibrated material. Included in the defibrated material are the detangled fibers of the feedstock, and material such as resin particles, color agents such as ink and toner, bleeding inhibitors, strengthening agents, and other additives that are separated from the fibers as the feedstock is defibrated and detangled.

The defibrator 20 defibrates in a dry process. An impeller mill, for example, can be used for the defibrator 20. More specifically, the defibrator 20 has a rotor (not shown in the figure) that turns at high speed, and a liner (not shown in the figure) positioned around the outside of the rotor. The shreds produced by the shredder 12 go between the rotor and the liner of the defibrator 20 and defibrated. The defibrator 20 produces an air current by rotation of the rotor. By this air current the defibrator 20 suctions the shreds from the conduit 6, and conveys the defibrated material to the outlet 24. The defibrated material is delivered from the outlet 24 to a conduit 3.

A defibrator blower 26 is disposed to the conduit 3, and the air stream produced by the defibrator blower 26 sends the defibrated material from the conduit 3 to the inlet 42 of the screener 40.

The screener 40 classifies the defibrated material introduced from the inlet 42 based on fiber length. More specifically, the screener 40 separates the defibrated material defibrated by the defibrator 20 into first screened material consisting of defibrated material of a predetermined size or smaller, and second screened material consisting of defibrated material that is larger than the first screened material. The first screened material contains both fiber and particulate. The second screened material includes, for example, large fibers, undefibrated clumps (shreds that have not be sufficiently defibrated), and clumps of agglomerated or tangled defibrated threads.

The screener 40 has a drum 41, and a housing 43 enclosing the drum 41.

The drum 41 is a cylindrical sieve driven rotationally by a motor. The drum 41 has mesh (filter, screen), and functions as a sieve. By appropriately sizing the mesh, the drum 41 separates the defibrated material introduced from the inlet 42 into first screened material of a desired size that is smaller than the mesh openings, and second screened material that is larger than the mesh. The mesh of the drum 41 may be a metal screen, expanded metal made by expanding a metal sheet with slits formed therein, or punched metal having holes formed by a press in a metal sheet, for example.

The first screened material selected by the drum 41 is dispersed in air through the mesh of the drum 41, and drops onto the mesh belt 46 of the first web forming device 45 located below the drum 41.

The second screened material that cannot pass through the mesh of the drum 41 flows with the air current introduced from the inlet 42 to the drum 41 to the outlet 44, and fed into another conduit 8. The conduit 8 connects the inside of the drum 41 to the conduit 6. The second screened material flowing through the conduit 8 then flows through the conduit 6 with the shreds from the shredder 12, and is reintroduced to the inlet 22 of the defibrator 20. As a result, the second screened material is returned to the defibrator 20 and defibrated again.

The first web forming device 45 includes a mesh belt 46, rollers 47, and a suction device 48 (suction mechanism). The mesh belt 46 is an endless belt, is tensioned by three tension rollers 47, and moves in the direction indicated by the arrow in the figure by operation of the tension rollers 47. The surface of the mesh belt 46 is configured by mesh with openings of a specific size. Of the first screened material that drops from the screener 40, particulate of a size that passes through the mesh drops through the mesh belt 46, and fiber that is too large to pass through the mesh accumulates on the mesh belt 46, and is conveyed with the mesh belt 46 in the direction of the arrow.

The particulate that drops from the mesh belt 46 includes material in the defibrated material that is relatively small or low in density (such as resin particles and color agents). The remnants of the first screened material after impurities are removed are material that is suited to manufacturing a sheet S, and accumulates on the mesh belt 46, forming a first web W1.

The mesh belt 46 moves at speed V1 while making a sheet S. The conveyance speed V1 of the mesh belt 46, and stopping and starting conveyance by the mesh belt 46, are controlled by the control device 110.

The suction device 48 pulls air from below the mesh belt 46. The suction device 48 connects through conduit 23 to a dust collector 27. The dust collector 27 separates and collects from the air current. A collection blower 28 is disposed downstream from the dust collector 27, and the collection blower 28 pulls air from the dust collector 27. The air the collection blower 28 discharges passes through a conduit 29 and is vented to the outside of the sheet manufacturing apparatus 100.

As described above, fiber in the first screened material from which unwanted particles have been removed as described above accumulates on the mesh belt 46, forming a first web W1. Formation of the first web W1 on the mesh belt 46 is promoted and unwanted material is removed by the suction of the collection blower 28.

The configuration that selects and separates the first screened material and second screened material is not limited to a screener 40 having a drum 41. For example, a configuration that uses a classifier to classify defibrated material defibrated by the defibrator 20 may be used. Examples of such a classifier include cyclone classifiers, elbow jet classifiers, and eddy classifiers. The defibrated material can be selectively separated into first screened material and second screened material using such a classifier.

A rotor 49 that breaks up the first web W1 accumulated on the mesh belt 46 is disposed to the conveyance path of the mesh belt 46 on the downstream side of the conveyance path of the screener 40. The first web W1 is separated from the mesh belt 46 and broken up by the rotor 49 at the position where the mesh belt 46 is returned to the upstream side by a roller 47.

The first web W1 is a soft web of accumulated fiber, and the rotor 49 detangles the fibers of the first web W1 into a form that can be easily mixed with additives by the mixing device 50.

The rotor 49 may be configured as desired, and in this embodiment the rotor 49 has a rotor vane configuration of flat rotating blades. The rotor 49 is located at a position where the blades contact the first web W1 separated from the mesh belt 46. By rotation of the rotor 49 (for example, rotation in the direction indicated by the arrow R in the figure), the blades of the rotor 49 strike and break up the first web W1 separated and conveyed from the mesh belt 46 into fragments P.

The fragments P cut by the rotor 49 drop through a conduit 7, and are carried (conveyed) to the mixing device 50 by the air current flowing through the conduit 7.

The mixing device 50 has an additive supply device 52 that supplies an additive including resin to bind fibers together, a conduit 54 that communicates with the conduit 7 and through which a current carrying the fragments P flows, and a mixing blower 56. As described above, the fragments P are fiber from which impurities have been removed from the first screened material that past the screener 40. The mixing device 50 mixes an additive including resin with the fiber in the fragments P.

In the mixing device 50, an air current is produced by the mixing blower 56, and the fragments P and additive are mixed while being conveyed through the conduit 54. The fragments P are detangled into a finer fibrous state in the process of flowing through the conduit 7 and conduit 54.

Note that the additive supply device is an example of a binder supply device.

As shown in FIG. 3, additive cartridges 501 holding additive are removably installed to the additive supply device 52. Multiple additive cartridges 501 can be installed to the additive supply device 52, and a discharge unit 52*a*, supply adjustment valve 52*b*, and supply conduit 52*c* are disposed for each additive cartridge 501.

The additive cartridges 501 are box shaped with a space inside, and are installed to the top of the discharge unit 52*a* of the additive supply device 52. The discharge unit 52*a* connects through the supply conduit 52*c* to the conduit 54. The supply adjustment valve 52*b* is disposed between the discharge unit 52*a* and supply conduit 52*c*. The supply adjustment valve 52*b* adjusts the amount of additive that flows from the discharge unit 52*a* into the supply conduit 52*c*.

The additive stored in a additive cartridge 501 is supplied through the discharge unit 52*a*, supply adjustment valve 52*b*, and supply conduit 52*c* to the conduit 54.

A circuit board 18 with a memory device (CSIC: Customer Service Integrated Circuit) is disposed to each additive cartridge 501. The additive cartridge 501 also has multiple exposed contact terminals (not shown in the figure) for electrically connecting to the circuit board 18. The circuit board 18 electrically connects to the control device 110 through the contact terminals.

The circuit board 18 is an example of a second storage, and stores second information (such as additive information, type of feedstock MA, type of sheet S, sheet S manufacturing speed) readably. In other words, a circuit board 18 enabling reading second information is disposed to the additive supply device 52 (additive cartridge 501) individually storing different types of additive (binder).

Note that the circuit board 18 may be a contact IC chip or a contactless IC chip (such as an RFID (Radio Frequency IDentifier) chip).

The additive stored in the additive cartridge 501 includes a resin (binder) for binding fibers together. The resin contained in the additive is a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone.

In addition to resin for binding fibers, and depending on the type of sheet being manufactured, the additive stored in the additive cartridge 501 may also include a coloring agent for coloring the fiber, an anti-blocking agent to prevent agglomeration of fibers and agglomeration of resin, or a flame retardant for making the fiber difficult to burn, for example. The additive not containing a coloring agent may be colorless or a color light enough to be considered colorless, or white.

Note that the resin contained in the additive is an example of a binder.

In this embodiment of the invention seven additive cartridges 501 can be installed to the additive supply device 52. Each additive cartridge 501 may contain the desired type of additive. For example, by installing additive cartridge 501 storing different colors of additive, a yellow additive, magenta additive, and cyan additive can be supplied from the additive supply device 52 to the conduit 54. Additive cartridges 501 containing a white additive and a colorless (plain) additive may also be installed, and additive cartridges 501 storing other colors of additives may be installed.

The additive supply device 52 can supply additive from any one or more additive cartridges 501 selected from among the multiple additive cartridges 501 installed to the additive supply device 52. For example, the control device 110 can manufacture a green sheet S by controlling the additive supply device 52 to supply additive from a additive cartridge 501 storing yellow additive and a additive cartridge 501 storing cyan additive cartridge 501.

Returning to FIG. 1, fragments P dropping through the conduit 7 and the additive supplied by the additive supply device 52 are suctioned through the conduit 54 by the air current produced by the mixing blower 56, and pass through the mixing blower 56. The fiber in the fragments P and the additive are mixed by the air current produced by the mixing blower 56 and/or the action of a rotating part such as the blades of the mixing blower 56, and the mixture of fiber and additive is conveyed through the conduit 54 to the air-laying device 60.

The mixture that past the mixing device 50 is introduced from an inlet 62 to the air-laying device 60, and the air-laying device 60 detangles the tangled defibrated material (fiber) and disperses the detangled fibers in air while the mixture precipitates. When the resin in the additive supplied from the additive supply device 52 is fibrous, the air-laying device 60 also detangles interlocked resin fibers. As a result, the air-laying device 60 can lay the mixture uniformly in the second web forming device 70.

The air-laying device 60 has a drum 61 and a housing 63 that houses the drum 61. The drum 61 is a cylindrical sieve driven rotationally by a motor. The drum 61 has mesh (filter, screen), and functions as a sieve. Based on the size of the mesh, the drum 61 causes fiber and particles smaller than the size of the mesh (that pass through the mesh) to precipitate from the drum 61. The configuration of the drum 61 in this example is the same as the configuration of the drum 41 described above.

A second web forming device 70 is disposed below the drum 61. The second web forming device 70 accumulates the material precipitated from the air-laying device 60, forming a second web W2 as an example of a mixture of fiber and binder.

The second web forming device 70 includes, for example, a mesh belt 72, tension rollers 74, and a suction mechanism 76.

The mesh belt 72 is an endless belt, is tensioned by multiple tension rollers 74, and by operation of the tension rollers 74 is driven in the direction indicated by arrow V2 in the figure. The mesh belt 72 may be metal, plastic, cloth, or nonwoven cloth. The surface of the mesh belt 72 is a screen with openings of a specific size. Of the fiber and particulate dropping from the drum 61, particulate of a size that passes through the mesh drops through the mesh belt 72, and fiber of a size that cannot pass through the openings in the mesh accumulates on the mesh belt 72 and is conveyed in the direction of the arrow with the mesh belt 72. The mesh belt 72 moves at a constant speed V2 during the operation of making a sheet S.

The openings in the mesh of the mesh belt 72 are fine, and can be sized so that most of the fiber and particles dropping from the drum 61 does not pass through.

A suction mechanism 76 is disposed below the mesh belt 72 (on the opposite side as the air-laying device 60). The suction mechanism 76 includes a suction blower 77, and by the suction of the suction blower 77 produces a flow of air from the air-laying device 60 through the mesh belt 72.

The mixture distributed in air by the air-laying device 60 is pulled onto the mesh belt 72 by the suction mechanism 76. As a result, formation of the second web W2 on the mesh belt 72 is promoted, and the discharge rate from the air-laying device 60 can be increased. A downward air flow can also be created in the descent path of the mixture, and interlocking of defibrated material and additive during descent can be prevented, by the suction mechanism 76.

The suction blower 77 may be configured to discharge from the sheet manufacturing apparatus 100 air suctioned from the suction mechanism 76 and past through a collection filter not shown. The suction blower 77 may push the suctioned air to the dust collector 27 to collect the impurities contained in the air suctioned by the suction mechanism 76.

A soft, fluffy second web W2 containing much air is thus formed by passing through the air-laying device 60 and second web forming device 70. The second web W2 accumulated on the mesh belt 72 is then conveyed to the sheet forming unit 86.

A conveyor 79 that delivers the second web W2 on the mesh belt 72 to the sheet forming unit 86 is disposed on the downstream side of the conveyance path of the mesh belt 72. The conveyor 79 includes, for example, a mesh belt 79*a*, rollers 79*b*, and a suction mechanism 79*c*.

The suction mechanism 79*c* includes a blower (not shown in the figure), and by the suction force of the blower produces an upward air current on the mesh belt 79*a*. This air current pulls the second web W2, and the second web W2 separates from the mesh belt 72 and sticks to the mesh belt 79*a*. The mesh belt 79*a* moves in conjunction with the rollers 79*b*, and conveys the second web W2 to the sheet forming unit 86.

In this way, the conveyor 79 separates the second web W2 formed on the mesh belt 72 from the mesh belt 72, and conveys the second web W2 to the sheet forming unit 86.

The sheet forming unit 86 has a compression device 84 that compresses the second web W2, and a heater group 80 that heats the second web W2 after being compressed by the compression device 84.

In the sheet forming unit 86, the second web W2 compressed by the compression device 84 is heated by the heater group 80, and a sheet S is formed. More specifically, by applying heat to the second web W2, which is a mixture of fiber and resin (additive), the fibers in the mixture are bonded together by the resin in the sheet forming unit 86, and a sheet S is formed.

Note that the heater group 80 is an example of a heater.

The compression device 84 in this example comprises a pair of calender rolls 85 (pressure rollers) that hold and compress the second web W2 with a specific nipping force. Calendering reduces the thickness of the second web W2 and increases the density of the second web W2. One of the pair of calender rolls 85 is a drive roller that is driven by a motor (not shown in the figure), and the other is a driven roller that turns in conjunction with the drive roller. The calender rolls 85 turn in response to the drive power from a motor (not shown in the figure), compress the second web W2, and convey a high density second web W2 resulting from compression to the heater group 80.

The heater group 80 includes a first heater 81 disposed on the compression device 84 side, and a second heater 82 disposed on the cutting device 90 side. More specifically, the first heater 81 and second heater 82 are disposed sequentially in the conveyance direction of the second web W2. The second web W2 is heated by at least one of the first heater 81 and second heater 82.

The heaters 81 and 82 are described in detail below.

The cutting device 90 cuts and processes the sheet S formed by the sheet forming unit 86 into sheets S of a specific size (cut sheets). More specifically in this example, the cutting device 90 has a first cutter 92 that cuts the sheet S crosswise to the conveyance direction of the sheet S, and a second cutter 94 that cuts the sheet S parallel to the conveyance direction. In this example, the first cutter 92 is located on the upstream side in the conveyance direction of the sheet S, and the second cutter 94 is located on the downstream side in the conveyance direction of the sheet S. The sheet S formed by the sheet forming unit 86 is cut by the first cutter 92 and second cutter 94 into single sheets of a specific size.

The cut sheets cut from the sheet S by the cutting device 90 are then discharged toward a tray 96, and stacked on the tray 96.

Heater Configuration

Figure 4:
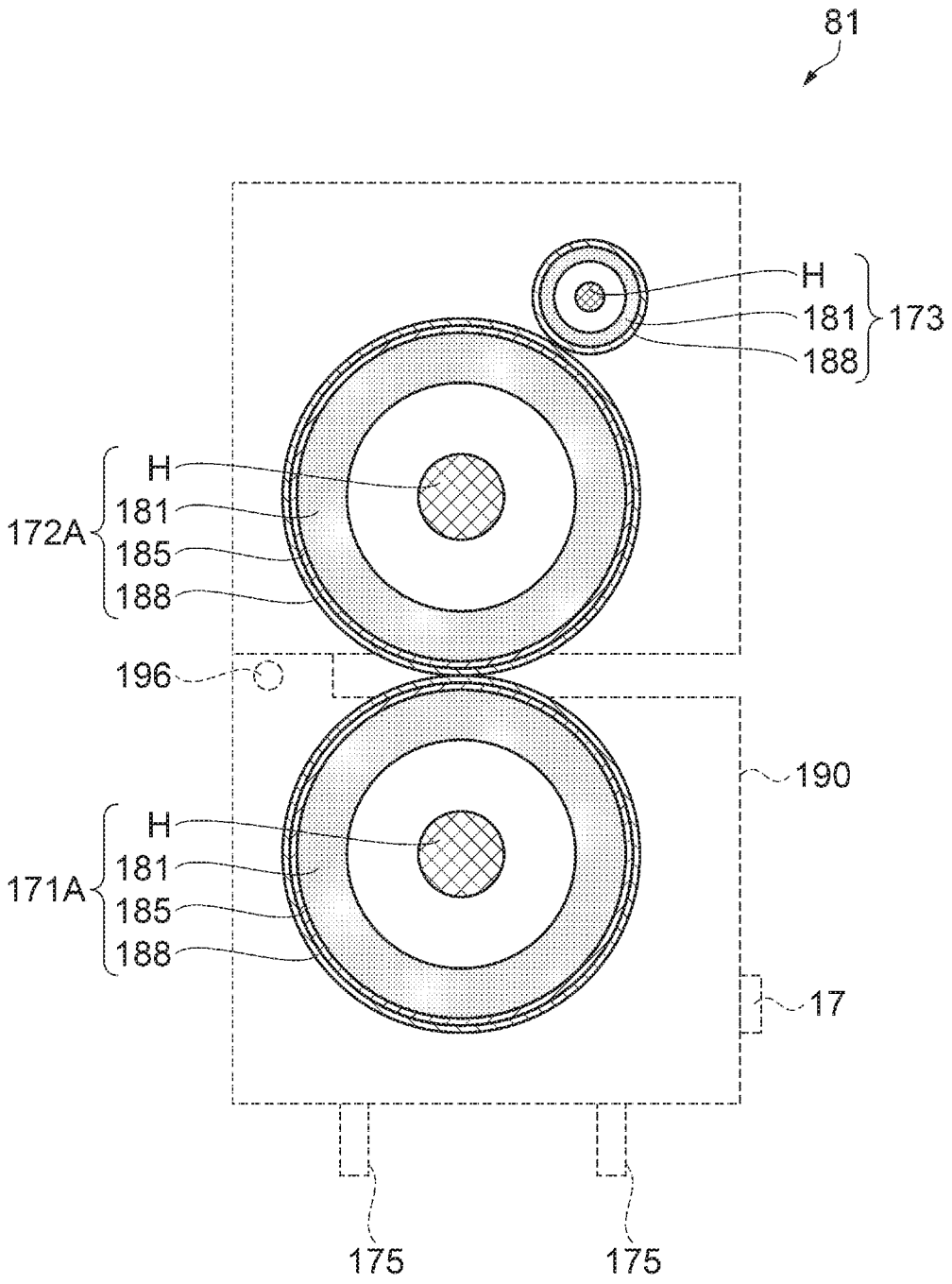
FIG. 4 illustrates the conventional of the heater.
Figure 5:
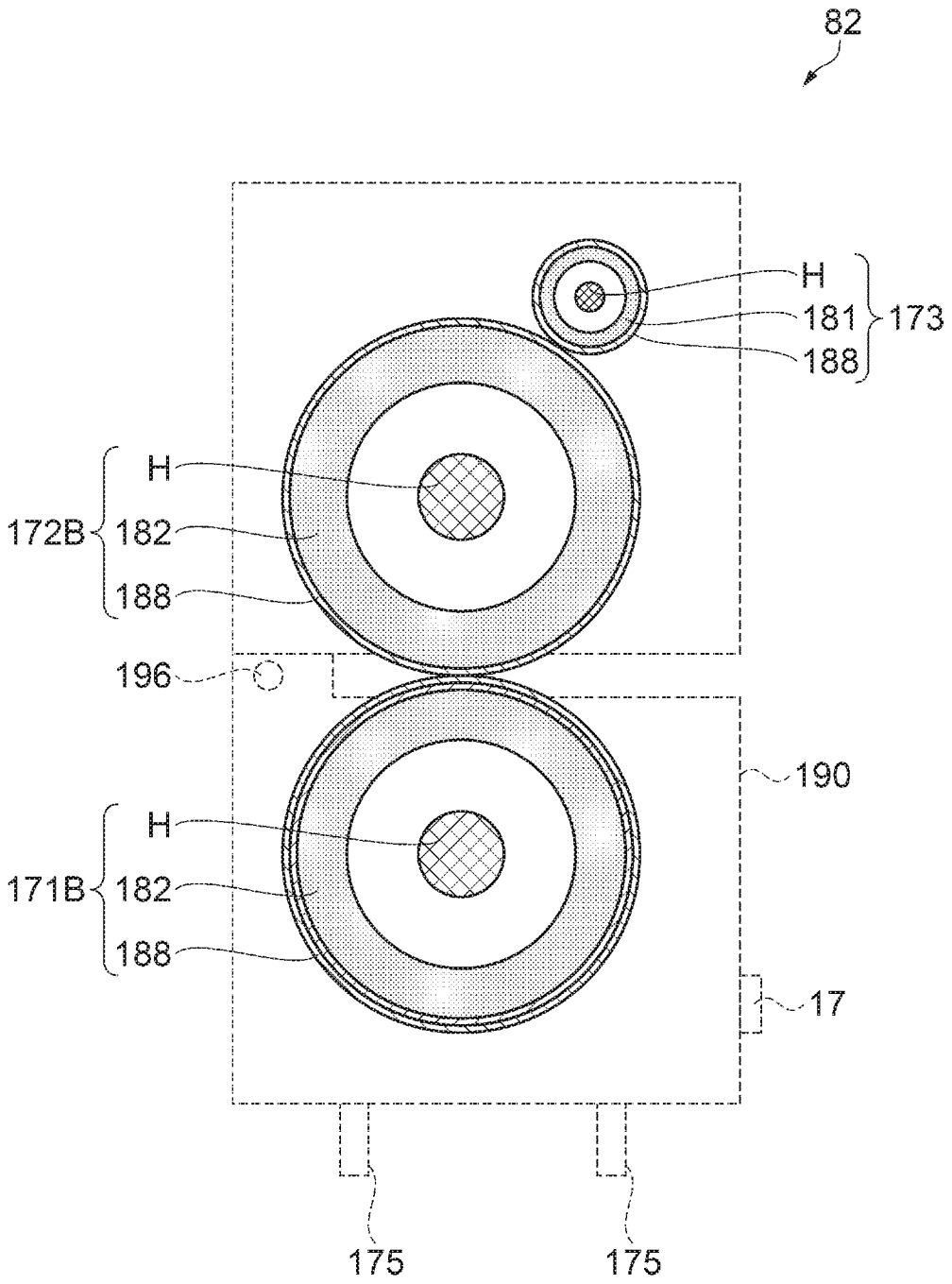
FIG. 5 illustrates the conventional of the heater.

FIG. 4 to FIG. 7 illustrate the configuration of the heaters. More specifically, FIG. 4 shows the configuration of the first heater 81, and FIG. 5 shows the configuration of the second heater 82.

To facilitate understanding the configuration of the heat rollers (first roller 171, second roller 172, third roller 173) in the heaters 81 and 82, elements other than the heat rollers (first roller 171, second roller 172, third roller 173) are indicated by dotted lines. To facilitate understanding the configuration of the moving mechanism 190 in the heaters 81 and 82 in FIG. 6 and FIG. 7, elements other than the moving mechanism 190 are indicated by the dotted lines.

Figure 6:
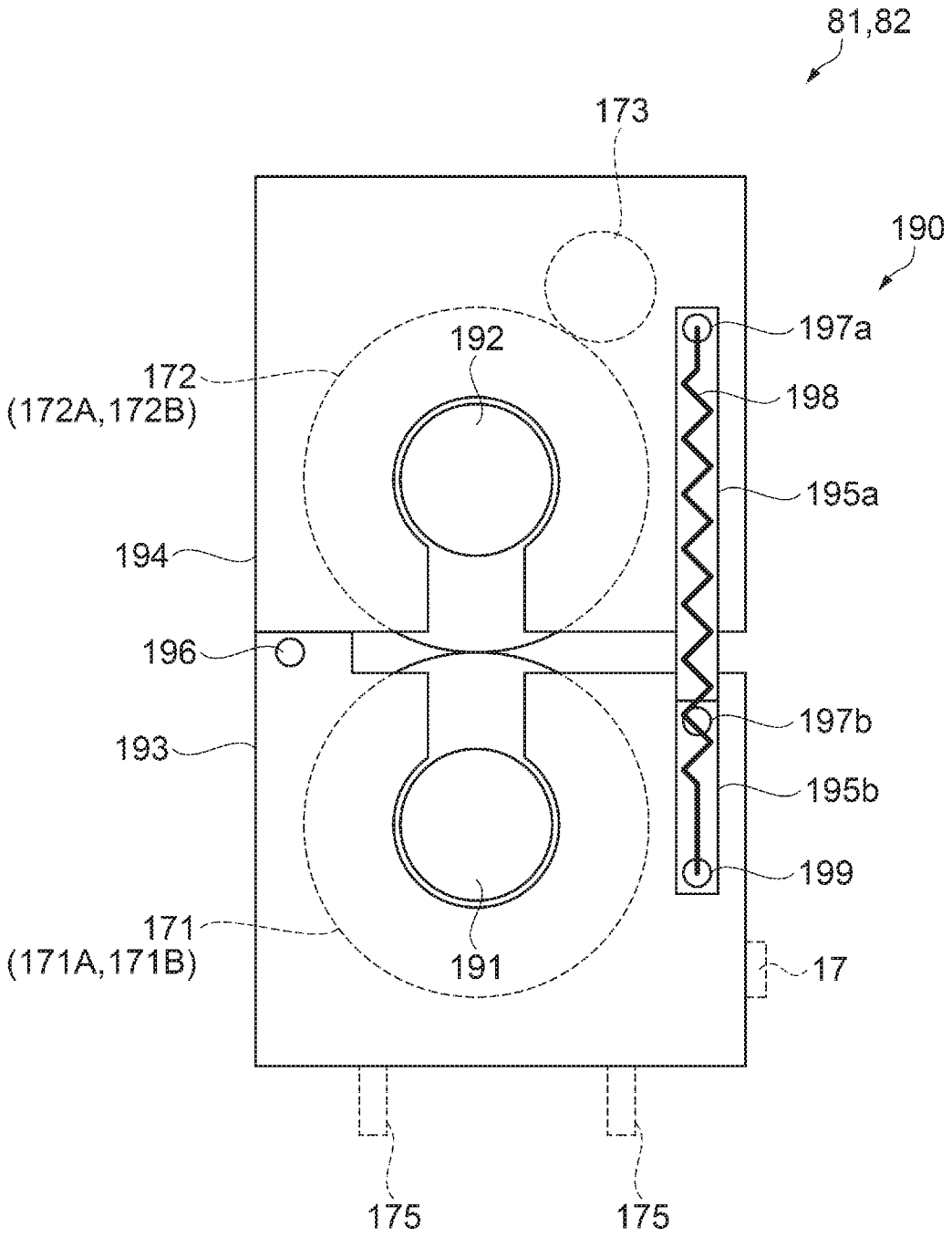
FIG. 6 illustrates the conventional of the heater.
Figure 7:
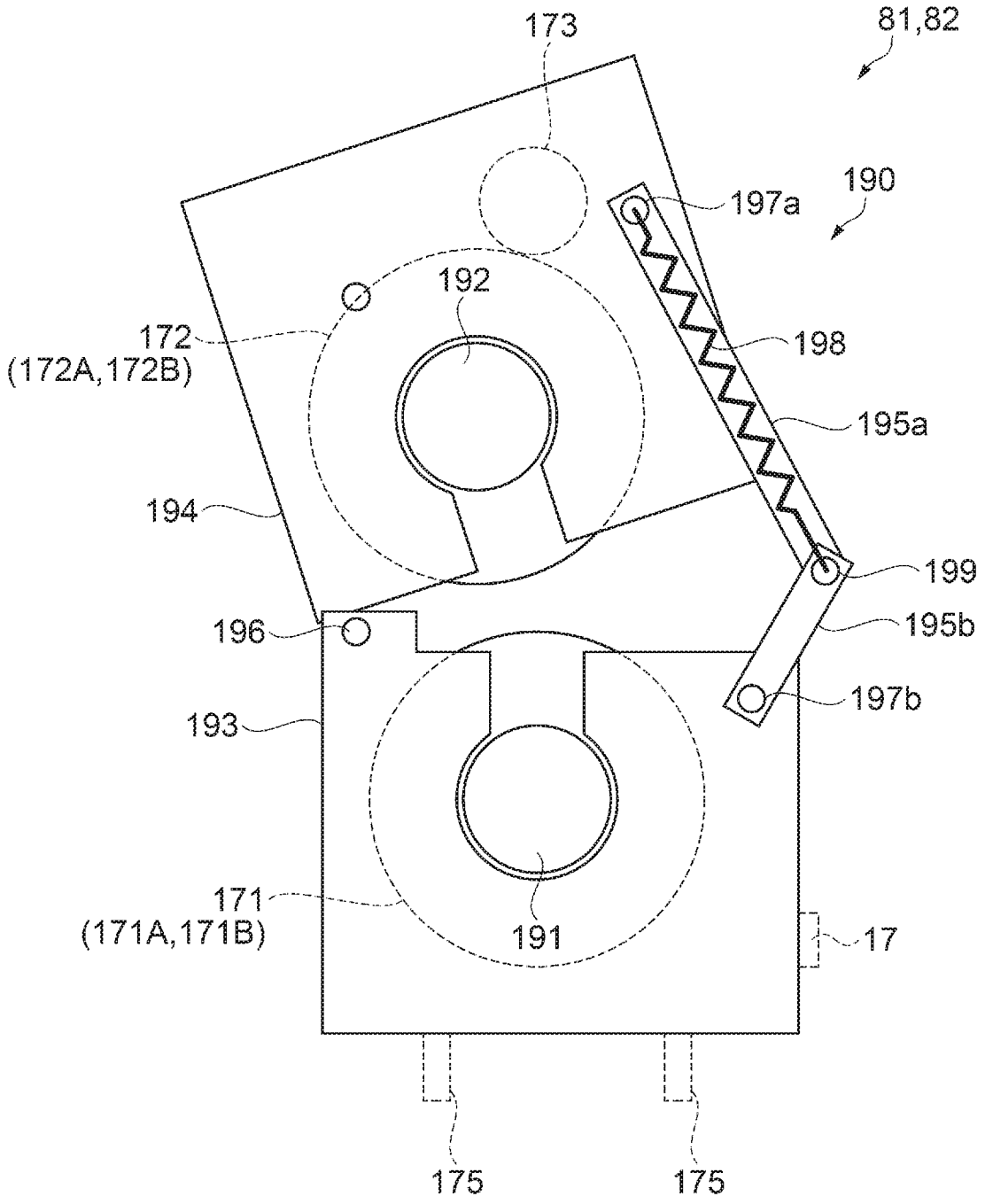
FIG. 7 illustrates the conventional of the heater.

In addition, FIG. 4 to FIG. 6 illustrate when the heaters 81 and 82 heat the second web W2. FIG. 7 illustrate when the heaters 81 and 82 do not heat the second web W2.

The heaters 81 and 82 are described next with reference to FIG. 4 to FIG. 7.

As shown in FIG. 4 and FIG. 5, the first heater 81 has a first roller 171A, a second roller 172A that holds the second web W2 between itself and the first roller 171A, a third roller 173, a moving mechanism 190, casters 175 that rotate freely, and a circuit board 17 as an example of a first storage.

The second heater 82 has a first roller 171B, a second roller 172B that holds the second web W2 between itself and the first roller 172A, a third roller 173, a moving mechanism 190, casters 175 that rotate freely, and a circuit board 17.

The first heater 81 is configured with the components of the first heater 81 (first roller 171A, second roller 172A, third roller 173, moving mechanism 190, casters 175, circuit board 17) as a single unit that can be removably installed in the housing (not shown in the figure) of the manufacturing unit 102. The mesh belt 72 is likewise configured with the components of the second heater 82 (first roller 171B, second roller 172B, third roller 173, moving mechanism 190, casters 175, circuit board 17) as a single unit that can be removably installed in the housing (not shown in the figure) of the manufacturing unit 102.

In other words, the heater group 80 described as an example of a heater in this embodiment is configured as a unit that can be removably installed to the sheet manufacturing apparatus 100. The heater group 80 configured as a removable unit includes a first heater 81, and a second heater 82 that can heat the second web W2 under different conditions than the first heater 81.

The casters 175 enable moving the heaters 81, 82. The operator can easily move the heaters 81 and 82 on the casters 175 to install and remove the heaters 81 and 82 from the housing (not shown in the figure) of the manufacturing unit 102.

A circuit board 17 with a storage device (CSIC) is disposed to each of the heaters 81 and 82. The heaters 81 and 82 have multiple contact terminals (not shown in the figure) that exposed to electrically connect to the circuit board 17. The circuit board 17 is electrically connected to the control device 110 through contact terminals.

The circuit board 17 is an example of a first storage, and store first information (the cumulative sum of the product of the heater 81, 82 operating time and heater 81, 82 operating temperature). In other words, circuit boards 17 readably storing first information are disposed to the heater group 80 (heaters 81, 82).

Note that the circuit board 17 may be a contact IC chip or a contactless IC chip (such as an RFID chip).

In the first heater 81, the first roller 171A, second roller 172A, and third roller 173 are heating rollers having an internal heat source H. The first roller 171A and second roller 172A hold the second web W2, which has been compressed to a high density by the compression device 84, therebetween, and heat the second web W2.

The third roller 173 is disposed touching the outside surface of the second roller 172A, and heats the outside surface of the second roller 172A. The outside surface of the second roller 172A (the surface that contacts the second web W2) is heated by the internal heat source H, and is also heated by the third roller 173. By providing this third roller 173, the outside surface of the second roller 172A can be quickly heated.

The first heater 81 also has a temperature sensor (not shown in the figure) that detects the temperature of the first roller 171A, second roller 172A, and third roller 173 (such as the temperature of the outside surface).

Note that the third roller 173 is not an essential element of the first heater 81, and may be omitted.

The first roller 171A and second roller 172A each have, disposed sequentially from the axis of rotation to the outside surface, a heat source H, cored bar 181, soft body 185, and a release layer 188.

The third roller 173 has, disposed sequentially from the axis of rotation to the outside surface, a heat source H, cored bar 181, and a release layer 188. In other words, the third roller 173 is configured without the soft body 185 disposed to the rollers 171A and 172A.

The cored bar 181 is a hollow rod with a space inside, and is made from aluminum, iron, stainless steel, or other metal. When the cored bar 181 is seen in section, the center of the cored bar 181 is the axis of rotation of the rollers 171A, 172A. The heat source H in this example is a halogen lamp, and is disposed inside the hollow cored bar 181.

The soft body 185 is a layer of silicone rubber, urethane rubber, fluoro rubber, nitrile rubber, butyl rubber, or acrylic rubber, for example. The soft body 185 is made from an elastic material (flexible material), and when the surface of the second web W2 is uneven, deforms according to the unevenness of the second web W2. When the soft body 185 deforms according to the surface of the second web W2, flattening the surface of the material is more difficult, and the sheet S formed by heating the second web W2 can be given a matte finish with suppressed luster.

The release layer 188 is made from a fluorocarbon polymer such as PFA (copolymer of tetrafluoroethylene and perfluoroalkylvinylether), or PTFE (polytetrafluoroethylene). By providing a release layer 188, the second web W2 or sheet S separates more easily from the roller 171A, 172A.

Below, the heating rollers (rollers 171A, 172A) having a soft body 185 may also referred to as soft rollers.

In the second heater 82, the first roller 171B, second roller 172B, and third roller 173 are heating rollers having an internal heat source H. The first roller 171B and second roller 172B hold the second web W2, which has been compressed to a high density by the compression device 84, therebetween, and heat the second web W2.

The third roller 173 is disposed touching the outside surface of the second roller 172B, and heats the outside surface of the second roller 172B. The outside surface of the second roller 172B is heated by the internal heat source H, and is also heated by the third roller 173. By providing this third roller 173, the outside surface of the second roller 172B can be quickly heated.

The second heater 82 also has a temperature sensor (not shown in the figure) that detects the temperature of the first roller 171B, second roller 172B, and third roller 173 (such as the temperature of the outside surface).

Note that the third roller 173 is not an essential element of the second heater 82, and may be omitted.

The first roller 171B and second roller 172B each have, disposed sequentially from the axis of rotation to the outside surface, a heat source H, cored bar 182, and a release layer 188. More specifically, the rollers 171B, 172B of the second heater 82 are configured like the rollers 171A, 172A of the first heater 81 omitting for the soft body 185.

As described above, the third roller 173 has, disposed sequentially from the axis of rotation to the outside surface, a heat source H, cored bar 181, and a release layer 188.

The cored bar 182 is made from a material with greater thermal conductivity than the cored bar 181, and heat from the heat source H transfers more easily than in the cored bar 181. More specifically, the cored bar 182 is made from copper or an alloy of copper. Because rollers 171B, 172B do not have a soft body 185, heat from the heat source H transfers more easily to the outside surface than in rollers 171A, 172A that have a soft body 185. As a result, rollers 171B, 172B heat more quickly than rollers 171A, 172A, and can quickly heat the second web W2.

Because rollers 171B, 172B do not have a soft body 185, when the second web W2 has an uneven surface, the rollers 171B, 172B compress the second web W2 and flatten unevenness in the second web W2. As a result, in a sheet S formed by heating the second web W2, unevenness in the surface of the second web W2 is flattened, and the sheet S can be given a glossy finish with improved luster.

Below, the heating rollers (rollers 171B, 172B) without a soft body 185 may also referred to as hard rollers.

Using the soft rollers (rollers 171A, 172A), which do not flatten the surface of the second web W2, is therefore preferable to make a sheet S with a textured, low luster, matte finish.

Using the hard rollers (rollers 171B, 172B), which easily flatten the surface of the second web W2, is therefore preferable to make a sheet S with a hard, high luster, glossy finish.

Note that matte and glossy finishes are examples of sheet quality and texture.

As shown in FIG. 6 and FIG. 7, the moving mechanism 190 includes a first bearing 193 that rotationally supports the axle 191 of the first roller 171; a second bearing 194 that rotationally supports the axle 192 of the second roller 172; a first rod 195*a*, and a second rod 195*b*. The first bearing 193 and second bearing 194 are connected together pivotably (movably relative to each other) on an axle 196. One end of the first rod 195*a* is disposed to the second bearing 194 pivotably on an axle 197*a*, and one end of the second rod 195*b* is disposed to the first bearing 193 pivotably on an axle 197*b*. An urging member 198 (spring) is disposed to the first rod 195*a*. One end of the urging member 198 is connected to axle 197*a*, and the other end of the urging member 198 is connected to the other end 199 of the second rod 195*b*.

The moving mechanism 190 has a drive mechanism (not shown in the figure) that drives the second rod 195*b* rotationally on axle 197*b*.

In the position shown in FIG. 7, when the second rod 195*b* pivots clockwise, the first roller 171 and second roller 172 move to the position in mutual contact as shown in FIG. 6. At this time, the urging member 198 urges the first bearing 193 (first roller 171) to the second bearing 194 (second roller 172) side, and the second bearing 194 to the first bearing 193 side.

When the second rod 195*b* then pivots counterclockwise from the position shown in FIG. 6, the first roller 171 and second roller 172 separate as shown in FIG. 7.

In this way the moving mechanism 190 moves the heater 81, 82 from the position not heating the second web W2 (shown in FIG. 7) to the position where the heater 81, 82 heat the second web W2 (shown in FIG. 6). In addition, the moving mechanism 190 moves the heater 81, 82 from the position heating the second web W2 (shown in FIG. 6) to the position where the heater 81, 82 do not heat the second web W2 (shown in FIG. 7).

More specifically, the moving mechanism 190 moves the first roller 171 and second roller 172 between the position holding the second web W2 and the position where the first roller 171 and second roller 172 are separated and do not hold the second web W2.

Therefore, by providing the moving mechanism 190, a state in which the first roller 171A and second roller 172A and hold the second web W2, and only the first heater 81 heats the second web W2; a state in which the first roller 171B and second roller 172B hold the second web W2, and only the second heater 82 heats the second web W2; and a state in which first rollers 171A, 171B and second rollers 172A, 172B hold the second web W2, and both first heater 81 and second heater 82 heat the second web W2, can be selected.

As described above, the sheet manufacturing apparatus 100 can select a first mode in which only the first heater 81 heats the second web W2; a second mode in which only the second heater 82 heats the second web W2; and a third mode in which both the first heater 81 and the second heater 82 heat the second web W2, can be selected. In other words, the sheet manufacturing apparatus 100 enables heating the second web W2 using either or both the first heater 81 and second heater 82.

Note that the first mode is used to make a sheet S with a matte finish and suppressed shine because the soft rollers (rollers 171A, 172A) heat the second web W2.

The second mode is used to make a glossy sheet with high shine because the hard rollers (rollers 171B, 172B) heat the second web W2.

The third mode is used to make a sheet S at high speed because the soft rollers (rollers 171A, 172A) and hard rollers (rollers 171B, 172B) heat the second web W2.

The desirable heating temperature of the second web W2 varies according to the resins contained in the additive, the color agent contained in the additive, and other factors. The desirable heating temperature of the second web W2 also varies according to the type of pulp used to manufacture the feedstock MA (the type of feedstock MA). For example, the desirable heating temperature of the second web W2 is different for a second web W2 formed from feedstock MA made from the pulp of conifers and a second web W2 formed from feedstock MA made from deciduous trees. The desirable heating temperature of the second web W2 also varies according to the length and thickness of the fiber produced by defibrating the feedstock MA.

Because the heating temperature of the second web W2 thus varies according to the type of feedstock MA, the type of additive, and the state of the defibrated material (fiber), the heating temperature of the second web W2 must be changed when the type of feedstock MA or the type of additive changes in the sheet manufacturing apparatus 100.

To change the type of feedstock MA or change the type of additive when the sheet manufacturing apparatus 100 has only one heater, sheet S production by the sheet manufacturing apparatus 100 must be stopped and the temperature setting of the heater changed to heat the second web W2 at the desirable temperature. A loss of the sheet manufacturing apparatus 100 being unable to produce sheets S (referred to below as "condition changing loss") is therefore incurred while changing the temperature of the heater because the sheet manufacturing apparatus 100 cannot manufacture a sheet S.

The sheet manufacturing apparatus 100 according to this embodiment has a first heater 81, and a second heater 82 that can heat the second web W2 under different conditions than the first heater 81, and the heating temperature (heating condition) of the second web W2 can be separately set for the two heaters 81 and 82. For example, if while heating the second web W2 by one of the two heaters 81 and 82 the temperature of the other of the two heaters 81 and 82 is changed, the second web W2 can be heated by the one of the two heaters 81 and 82 and a sheet S can be produced while changing the temperature of the other of the two heaters 81 and 82, condition changing loss accompanying the temperature change of the heater 81, 82 is reduced, and the efficiency (productivity) of the sheet manufacturing apparatus 100 can be improved.

To change the type of sheet S that is formed by heating the second web W2 when the sheet manufacturing apparatus 100 has only one heater, such as to change from producing a sheet S with a matte finish to producing a sheet S with a glossy finish, the heater must be changed from soft rollers to hard rollers. Condition changing loss of the sheet manufacturing apparatus 100 being unable to produce sheets S is therefore incurred while switching from soft rollers to hard rollers because the sheet manufacturing apparatus 100 cannot manufacture a sheet S.

The sheet manufacturing apparatus 100 according to this embodiment has soft rollers (first heater 81) and hard rollers (second heater 82), and can switch between them by operating the moving mechanism 190. Therefore, in the sheet manufacturing apparatus 100 according to this embodiment, because there is no need to change the heater from soft rollers to hard rollers, or change the heater from hard rollers to soft rollers, condition changing loss of the sheet manufacturing apparatus 100 being unable to produce sheets S is reduced, and the efficiency (productivity) of the sheet manufacturing apparatus 100 can be improved.

In addition, because the sheet manufacturing apparatus 100 according to this embodiment has two heaters 81 and 82, if the second web W2 is heated using both of the two heaters 81 and 82, the sheet S processing speed can be increased compared with heating the second web W2 using only one of the two heaters 81 and 82, and the efficiency (productivity) of the sheet manufacturing apparatus 100 can be improved.

Because the sheet manufacturing apparatus 100 according to this embodiment can heat the second web W2 by at least one of two heaters 81 and 82, condition changing loss can be reduced compared with heating the second web W2 by only one heater, and the efficiency (productivity) of the sheet manufacturing apparatus 100 can be improved.

Because the heater group 80, which is an example of a heater, in this embodiment of the invention has a first heater 81 and a second heater 82 that can heat the second web W2 using different conditions than the first heater 81, the efficiency (productivity) of the sheet manufacturing apparatus 100 can be improved.

Note that "different conditions" as used herein means that one or more of the heating conditions of the second web W2, compression conditions of the second web W2, and the material of the first roller 171 or second roller 172 (for example, whether or not the roller has a soft body 185), is different.

Note that "different conditions" as used herein also means that one or more of the heating conditions of the second web W2, compression conditions of the second web W2, and the quality or texture (such as a matte finish or glossy finish) of the manufactured sheet S, is different.

Control Method of the Sheet Manufacturing Apparatus

Figure 8:
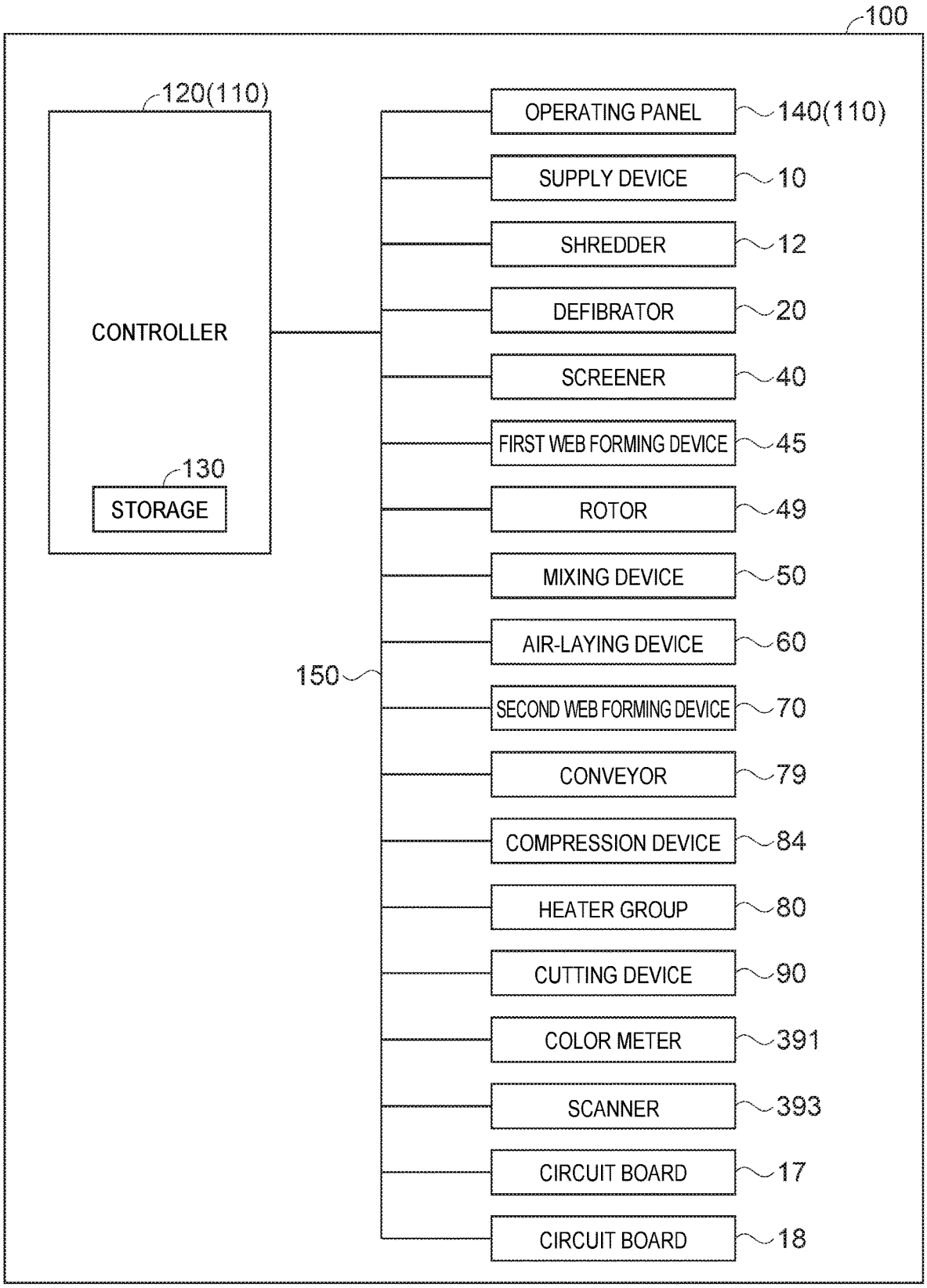
FIG. 8 is a block diagram of the control configuration of the sheet manufacturing apparatus according to the first embodiment of the invention.
Figure 9:
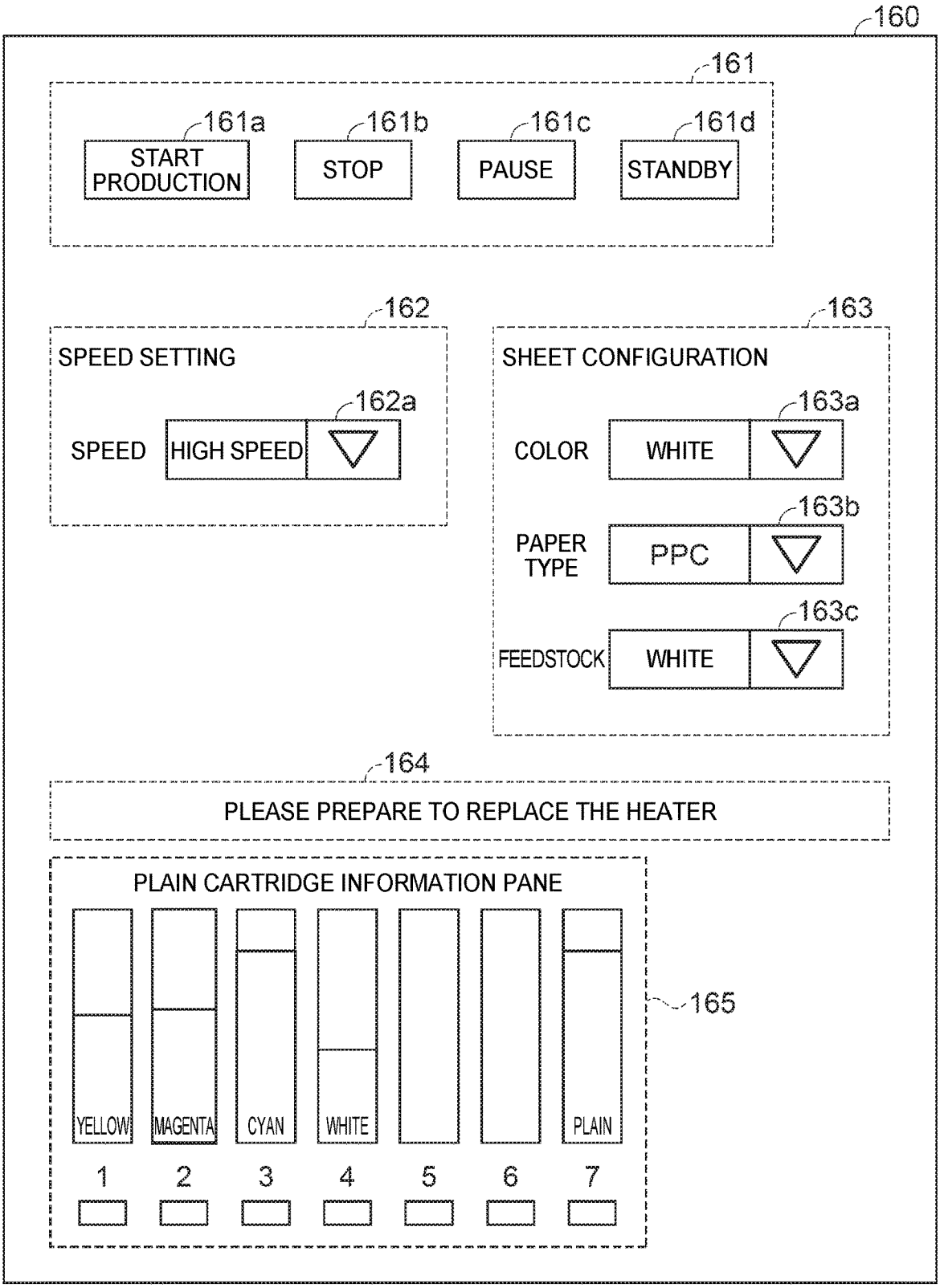
FIG. 9 shows an example of a screen displayed on the operating panel.
Figure 10:
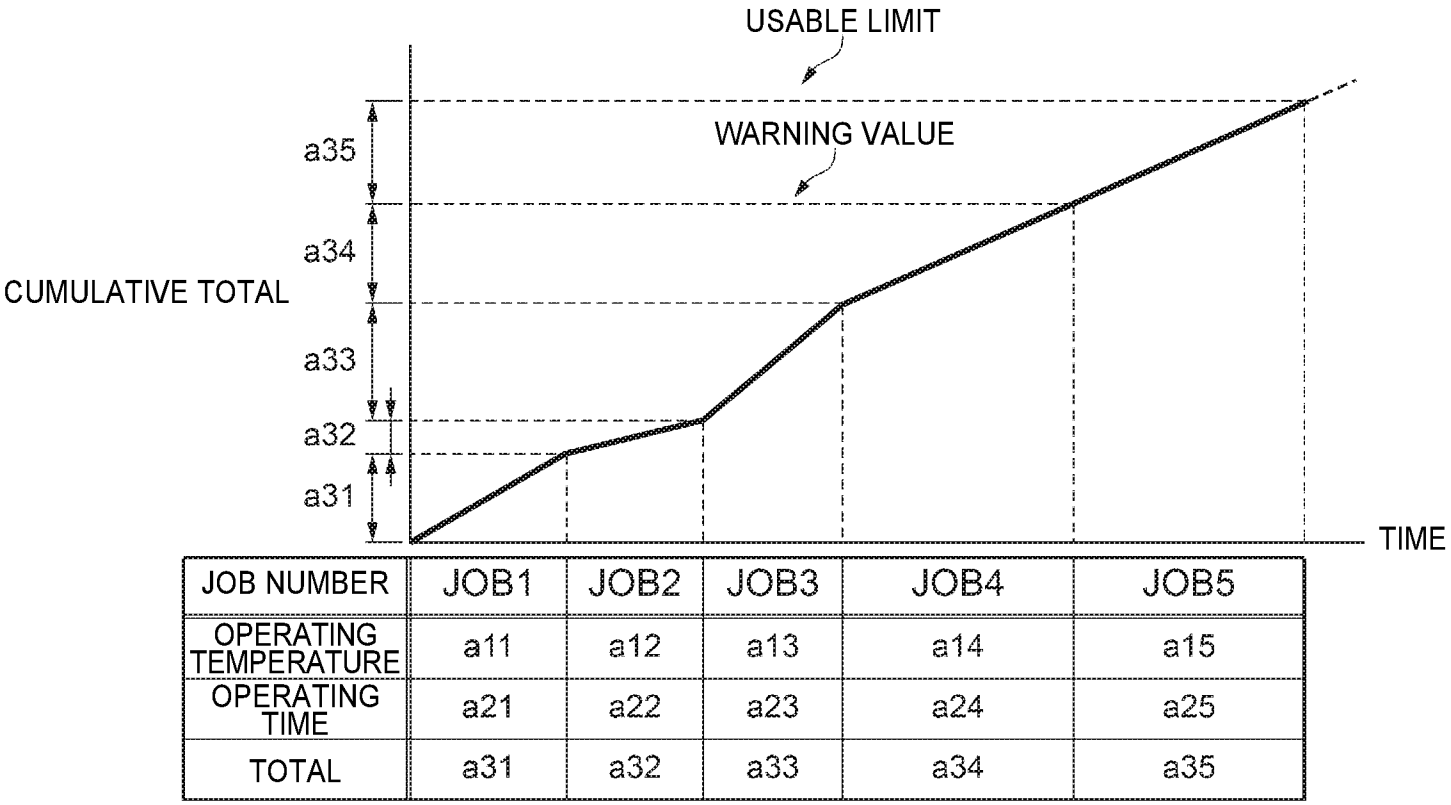
FIG. 10 shows an example of cumulative values.

FIG. 8 is a block diagram illustrating the control configuration of a sheet manufacturing apparatus according to this embodiment. FIG. 9 shows an example of a screen displayed on the operating panel. More specifically, FIG. 9 illustrates an operating screen 160 the operator uses to control the sheet manufacturing apparatus 100. FIG. 10 shows an example of cumulative values. In FIG. 10, the operating time of the heater is shown on the X-axis, and the cumulative values are shown on the Y-axis.

As shown in FIG. 8, the sheet manufacturing apparatus 100 has a controller 120, operating panel 140, supply device 10, shredder 12, defibrator 20, screener 40, first web forming device 45, rotor 49, mixing device 50, air-laying device 60, second web forming device 70, conveyor 79, compression device 84, heater group 80, cutting device 90, color meter 391, scanner 393, circuit board 17, and circuit board 18. The controller 120 has storage 130.

The controller 120, operating panel 140, supply device 10, shredder 12, defibrator 20, screener 40, first web forming device 45, rotor 49, mixing device 50, air-laying device 60, second web forming device 70, conveyor 79, compression device 84, heater group 80, cutting device 90, color meter 391, scanner 393, circuit board 17, and circuit board 18 communicatively connect through a bus 150.

The controller 120 and operating panel 140 are incorporated in the control device 110, and are components of the control device 110.

The storage 130 is configured, for example, with ROM storing specific information readably, and RAM storing information readably and writably.

The controller 120 controls parts of the manufacturing unit 102 (supply device 10, shredder 12, defibrator 20, screener 40, first web forming device 45, rotor 49, mixing device 50, air-laying device 60, second web forming device 70, conveyor 79, compression device 84, heater group 80, and cutting device 90).

The operating panel 140 in this example is an LCD panel with a touch panel mechanism. The operating panel 140 has functions for setting conditions required for the operation of the sheet manufacturing apparatus 100, and for displaying sheet manufacturing apparatus 100 conditions.

When the sheet manufacturing apparatus 100 turns on, an operating screen 160 such as shown in FIG. 9 is displayed on the operating panel 140. Included in the operating screen 160 are an operating command pane 161, speed setting pane 162, sheet configuration pane 163, message pane 164, and cartridge information pane 165.

The operating command pane 161 has a Start Production selector 161*a* that functions as a button to start sheet manufacturing apparatus 100 operation, a Stop selector 161*b*, a Pause selector 161*c*, and a Standby selector 161*d*. The operator selects the operation of the sheet manufacturing apparatus 100 using the buttons in the operating command pane 161.

The speed setting pane 162 has a Speed selector 162*a* used to set the sheet S production speed. By operating the Speed selector 162*a*, the operator can select the sheet S production speed from multiple predefined speed settings presented in a pulldown menu.

The sheet S production speed selected from the speed setting pane 162 is stored in the storage 130 of the controller 120.

The sheet configuration pane 163 has Color selector 163*a*, Paper Type selector 163*b*, and Feedstock selector 163*c* for setting the conditions of the sheet S the sheet manufacturing apparatus 100 manufactures.

By operating the Color selector 163*a*, the operator can select the color of the manufactured sheet S from multiple predefined color settings presented in a pulldown menu. The information about the color of the sheet S can also be read as information related to the color agent contained in the additive.

The color of the sheet S selected with the Color selector 163*a* is stored in the storage 130 of the controller 120. The additive cartridges 501 to be used are selected according to the color of the sheet S. For example, to manufacture a green sheet S, the additive cartridge 501 containing yellow additive, and the additive cartridge 501 containing cyan additive, are selected.

By operating the Paper Type selector 163*b*, the operator can select the type of the manufactured sheet S from multiple predefined paper type settings presented in a pulldown menu.

The paper type of the sheet S selected by the Paper Type selector 163*b* is an example of a type of sheet, and is stored in the storage 130 of the controller 120.

By operating the Feedstock selector 163*c*, the operator can select the type of feedstock MA used from multiple predefined feedstock type settings presented in a pulldown menu. The feedstock MA selected by the Feedstock selector 163*c* is the feedstock MA stored in the stackers 11 of the supply device 10.

In addition, the type of feedstock MA selected by the Feedstock selector 163*c* is stored in the storage 130 of the controller 120.

As described above, when the sheet manufacturing apparatus 100 turns on and the operating screen 160 is displayed on the operating panel 140, the sheet S production speed, sheet S color, sheet S type, and feedstock MA type selected through the operating panel 140 are stored in the storage 130 of the controller 120.

When additive is stored in an additive cartridge 501, information about the additive is stored as second information in the circuit board 18 disposed to the additive cartridge 501. The additive information includes the type of binder, and the heating temperature appropriate to the type of binder. More specifically, when additive is stored in an additive cartridge 501, the type of binder, and the heating temperature appropriate to the type of binder, for example, are stored as second information in the circuit board 18 disposed to the additive cartridge 501.

In other words, the second information readably stored in the circuit board 18 includes at least one of the type of binder, and the heating temperature appropriate to the type of binder.

The message pane 164 is a display area for presenting information for the operator by text or images. In the example in FIG. 9, the message "Please prepare to replace the heater" is displayed in the message pane 164.

The cartridge information pane 165 is a display area for presenting information related to the additive cartridges 501 installed (set) in the additive supply device 52. In the example in FIG. 9, the color and remaining amount of additive in each additive cartridge 501 is shown in the cartridge information pane 165.

A circuit board 17, which is an example of a first storage, is disposed to the heaters 81 and 82, and stores first information readably. The first information includes the cumulative total of the sequentially added products of the operating time of the heater 81, 82 and operating temperature of the heater 81, 82. The cumulative total of the sequentially added products of the operating time of the heater 81, 82 and operating temperature of the heater 81, 82 includes a warning value indicating that the heaters 81 and 82 are approaching the end of the usable service life, and a usable limit, which is the limit to which the heaters 81 and 82 can be used appropriately.

In other words, the first information includes the cumulative total of the sequentially added products of the operating time of the heater 81, 82 and operating temperature of the heater 81, 82, a warning value indicating that the heaters 81 and 82 are approaching the end of the usable service life, and a usable limit, which is the limit to which the heaters 81 and 82 can be used appropriately.

FIG. 10 shows the change in the cumulative values when the first heater 81 of heaters 81 and 82 is used to make sheets S in JOB1, JOB2, JOB3, JOB4, and JOB5. In addition, in FIG. 10 the first heater 81 cannot be used appropriately after JOB5 is completed.

As shown in FIG. 10, in JOB1, the operating temperature of heater 81 is a11, and the operating time of heater 81 is a21. The total a31 in JOB1 is obtained by equation (1) below.

$$a31=a11\times a21 \quad (1)$$

In JOB2, the operating temperature of heater 81 is a12, and the operating time of heater 81 is a22. The total a32 in JOB2 is obtained by equation (2) below.

$$a32=a12\times a22 \quad (2)$$

In JOB3, the operating temperature of heater 81 is a13, and the operating time of heater 81 is a23. The total a33 in JOB3 is obtained by equation (3) below.

$$a33=a13\times a23 \quad (3)$$

In JOB4, the operating temperature of heater 81 is a14, and the operating time of heater 81 is a24. The total a34 in JOB4 is obtained by equation (4) below.

$$a34=a14\times a24 \quad (4)$$

In JOB5, the operating temperature of heater 81 is a15, and the operating time of heater 81 is a25. The total a35 in JOB5 is obtained by equation (5) below.

$$a35=a15\times a25 \quad (5)$$

Below, the cumulative total of the sequentially added products of the operating time of the heater 81, 82 and operating temperature of the heater 81, 82 is referred to as total A1; the warning value indicating that the heaters 81 and 82 will soon become unusable is referred to as warning value B; and the usable limit, which is the limit to which the heaters 81 and 82 can be used appropriately, referred to as usable limit C.

For example, when a heater 81, 82 is used at 170° C. for 100 hours, total A1 is 170×100° C. hrs, or $1.7\times10^{4}$° C. hrs. When the heater 81, 82 is used at 170° C. for 50 hours, and then at 185° C. for 50 hrs, total A1 is (170×50+185×50) C hrs, or $1.8\times10^{4}$° C. hrs. When a heater 81, 82 is used at 170° C. for 50 hrs, then at 185° C. for another 50 hrs, and then at 190° C. for another 20 hrs, total A1 is (170×50+185×50+190×20)° C. hrs, or $2.2\times10^{4}$° C. hrs.

Below, the service life of the heater 81, 82 means the time until the heaters 81 and 82 cannot be used appropriately, or the time that the heaters 81 and 82 can be used appropriately. For example, estimating the remaining service life of the heater 81, 82 means estimating how long until the heaters 81 and 82 cannot be used appropriately. For example, that the service life of the heater 81, 82 is long means that heaters 81 and 82 can be used appropriately for a long time.

The service life of the heater 81, 82 (the time that the heaters 81 and 82 can be used satisfactorily) depends on the operating time of the heater 81, 82 and the operating temperature of the heater 81, 82. For example, as the operating time of the heater 81, 82 increases, the heaters 81 and 82 gradually deteriorate, and as the operating temperature of the heater 81, 82 increases, the heaters 81 and 82 gradually deteriorate. For example, even if the operating time of the heater 81, 82 is the same but the operating temperature of the heater 81, 82 rises, the heaters 81, 82 deteriorate quickly and the service life of the heaters 81, 82 becomes shorter. If the operating time of the heater 81, 82 is the same but the operating temperature of the heater 81, 82 drops, the service life of the heater 81, 82 increases.

As a result, deterioration of the heaters 81 and 82 can be evaluated based on the sequentially added total A1 of the products of the operating time of the heaters 81 and 82 and the operating temperature of the heaters 81 and 82.

The service life of the heaters 81 and 82 also varies according to the components of the heaters 81 and 82. For example, because the soft body 185 is more susceptible to thermal degradation, the service life of the first heater 81, which has a soft body 185, is shorter than the service life of the second heater 82, which does not have a soft body 185.

In this example, the usable limit C of the first heater 81 and second heater 82 is set to a default. The usable limit C of the first heater 81 and the usable limit C of the second heater 82 are set respectively based on the results of durability tests, for example.

In this embodiment, the usable limit C multiplied by 0.95 is set as the default warning value B. For example, if the usable limit C is $1\times10^{6}$° C. hrs the warning value B is set to $9.5\times10^{5}$° C. hrs. Note that the warning value B may be set as desired. For example, the usable limit C multiplied by 0.9 may be set as the warning value B.

The usable limit C can be changed (set), and the warning value B can be changed (set) through the operating panel 140.

The controller 120 acquires the first information (total A1, warning value B, usable limit C) stored in the circuit board 17. When a heater 81, 82 is operated again, the controller 120 also calculates the product D of the new operating time of the heater 81, 82 and the operating temperature of the heater 81, 82, adds the new product D to the total A1 to get the new total A2, and stores the new total A2 in the circuit board 17. More specifically, each time a heater 81, 82 is driven, the total A1 stored in the circuit board 17 is replaced with a new total A2.

When the new total A2 exceeds the warning value B, the heaters 81 and 82 are approaching the limit of usability, and the controller 120 therefore displays a warning such as "Please prepare to replace the heater 81, 82" informing the operator that a heater 81, 82 needs replacing soon in the message pane 164 of the operating screen 160 (see FIG. 9). When the message "Please prepare to replace the heater 81, 82" is displayed, the operator prepares to replace the heater 81, 82 that is near its service life with a new heater 81, 82 that has not deteriorated.

In other words, when the new total A2 exceeds the warning value B, the controller 120 prompts the user to replace the heater 81, 82 that is near the end of its service life. In other terms, the controller 120 predicts the remaining service life of the heater 81, 82 (how much time there is until the heater 81, 82 cannot be used satisfactorily) from the new total A2 and the warning value B, and prompts the operator to replace the heater 81, 82 when the heater 81, 82 is near the end of its service life (near the time there is until the heater 81, 82 cannot be used satisfactorily).

The control method of the sheet manufacturing apparatus 100 according to this embodiment thus estimates the service life of the heater 81, 82 so that the operator can prepare to replace the heater 81, 82 appropriately to the service life of the heater 81, 82.

For example, a PatLite® or buzzer may be disposed to the sheet manufacturing apparatus 100, and the operator may be prompted to replace the heater 81, 82 by lighting the PatLite or sounding the buzzer when the heater 81, 82 is near the end of its service life.

Because the heaters 81, 82 cannot be used appropriately when the new total A2 reaches the usable limit C, the controller 120 stops operation of the manufacturing unit 102, displays in the message pane 164 of the operating screen 160 a message to replace the heater, turns the heaters 81 and 82 off, and automatically stops the sheet S manufacturing process of the sheet manufacturing apparatus 100. As a result, problems related to heaters 81 and 82 that cannot operate as intended heating the mixture are suppressed.

When the message to replace a heater is displayed in the message pane 164 of the operating screen 160, the operator replaces the heater 81, 82 that cannot be used appropriately with a new heater 81, 82.

Because the components of the heaters 81 and 82 are unitized, the heaters 81 and 82 can be removed and replaced as a single component, and the time required to replace the heaters 81 and 82 is shorter than a configuration requiring disassembling the heater 81, 82 and replacing only the parts (components) that have deteriorated.

For example, a PatLite® or buzzer may be disposed to the sheet manufacturing apparatus 100, and the operator may be prompted to replace the heater 81, 82 by lighting the PatLite or sounding the buzzer when the heater 81, 82 has reached the end of its service life.

When the new total A2 reaches the usable limit C and operation of the manufacturing unit 102 is interrupted in the related art, the material being processed by the manufacturing unit 102 (first web W1, second web W2) becomes defective. In addition, if the new heater 81, 82 is readied after operation of the manufacturing unit 102 has been interrupted, a long time may be required to prepare a new heater 81, 82 for installation, and the manufacturing unit 102 therefore remains stopped for a long time. More specifically, if a new heater 81, 82 is not kept in stock, a long time may be required to acquire a new heater 81, 82, and production by the manufacturing unit 102 remains stopped for a long time.

However, because this embodiment of the invention predicts when a heater 81 and 82 will reach the end of its service life, and enables scheduling when to replace the heater 81, 82, loss from the material being processed by the manufacturing unit 102 (first web W1, second web W2) becoming defective can be suppressed.

In addition, even if heaters 81 and 82 are not kept in stock when the end of the service life of the heaters 81 and 82 is predicted so that a new heater 81, 82 can be prepared in advance, a new heater 81, 82 can still be readied before the heater 81, 82 becomes unusable, and loss from processing by the manufacturing unit 102 being stopped while waiting for a new heater 81, 82 can be suppressed.

Because the control method of the sheet manufacturing apparatus 100 according to this embodiment predicts the end of the service life of the heaters 81, 82 and enables preparing a new replacement heater 81, 82 according to the service life of the heater 81, 82, the efficiency (productivity) of the sheet manufacturing apparatus 100 can be improved.

Processing by the manufacturing unit 102 may also stop when changing the type of feedstock MA or the type of additive, and when changing the type of sheet S. If the new heater 81, 82 that was readied is installed while processing by the manufacturing unit 102 is stopped in these events, loss from processing by the manufacturing unit 102 being stopped can be further reduced.

Furthermore, because the components of the heaters 81 and 82 are unitized, and the heaters 81 and 82 can be removed and replaced as a single component, the time required to replace the heaters 81 and 82 is shorter than with a configuration in which the heaters 81 and 82 are not complete units and parts must be replaced individually, and loss from processing by the manufacturing unit 102 being stopped can be further reduced. This is particularly effective when small lot production of many different products is required.

As described above, first information (the cumulative total of the sequentially added products of the operating time of the heater 81, 82 and operating temperature of the heater 81, 82) is stored in the circuit board 17 of the heater 81, 82.

Second information (such as the type of binder, and the heating temperature appropriate to the type of binder) is readably stored in the circuit board 18 disposed to the additive cartridge 501.

Input information (such as the sheet S production speed, sheet S color, sheet S type, and feedstock MA type) is stored in the storage 130 of the controller 120.

Of the type of feedstock MA, type of sheet S, and sheet S production speed in the input information stored in the storage 130 of the sheet manufacturing apparatus 100, at least one can be selectively set.

Based on the first information, second information, and input information, the controller 120 determines the heating temperature of the heaters 81 and 82, and selectively uses the first heater 81 or second heater 82, or uses both the first heater 81 and second heater 82, to heat the mixture.

In addition, based on the first information, second information, and input information, the controller 120 determines the heating temperature of the heaters 81 and 82, and selects which of the multiple heaters (first heater 81 and second heater 82) is the heater suited to heating the mixture. More specifically, which of the multiple heaters (first heater 81 and second heater 82) is the heater suited to heating the mixture is automatically selected.

For example, when the selected type of sheet S has a matte finish, the controller 120 heats the second web W2 with the soft rollers (first heater 81). When the selected type of sheet S has a glossy finish, the controller 120 heats the second web W2 with the hard rollers (second heater 82). When the sheet S production speed is set to a high speed, the controller 120 heats the second web W2 with both the first heater 81 and second heater 82.

Because the heater is automatically selected and the heating temperature is set automatically, the operation required to make a sheet S is more efficient than when the operator must manually select the heater and set the heating temperature, and operator errors can be reduced.

Embodiment 2

Figure 11:
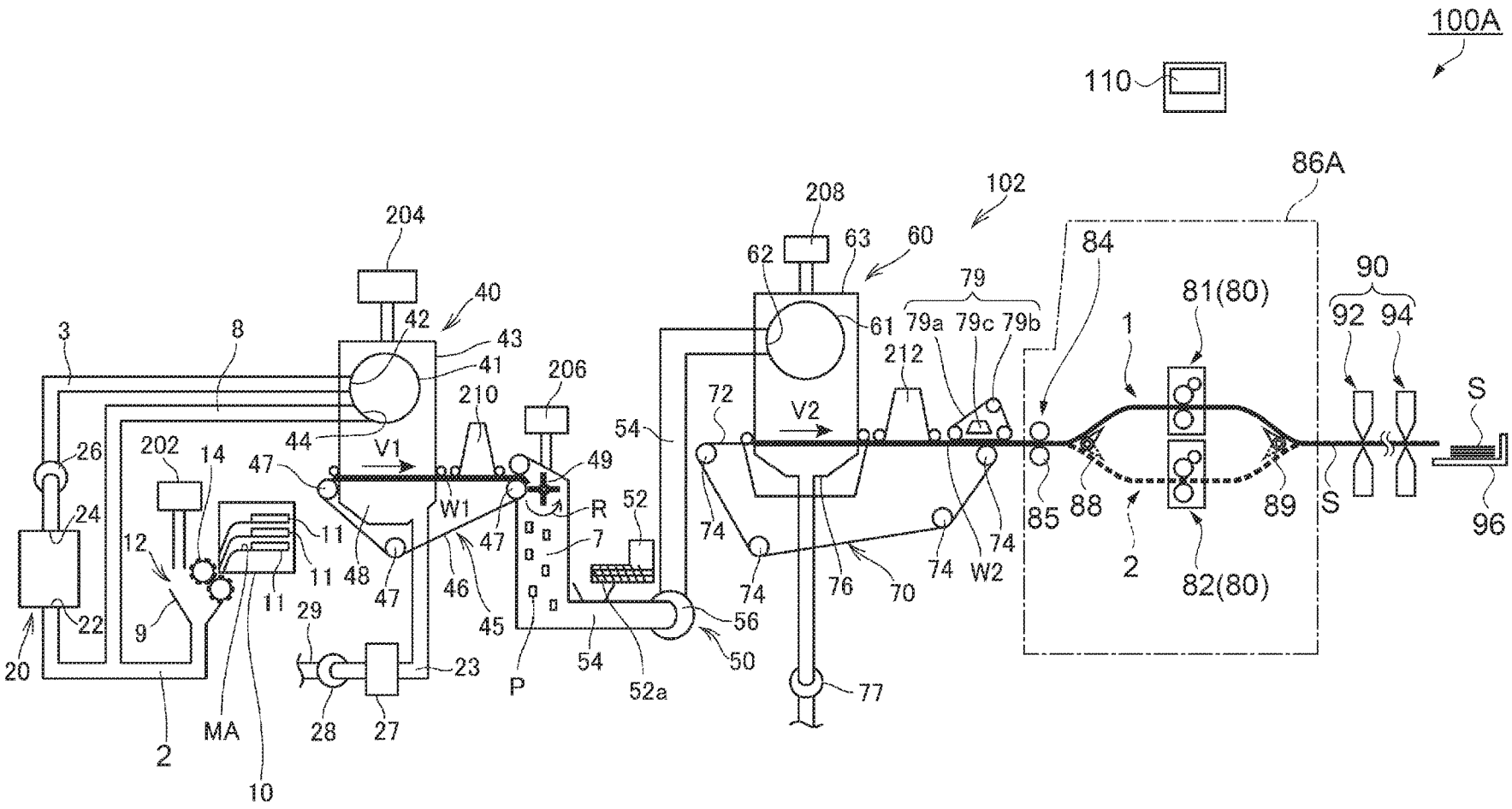
FIG. 11 schematically illustrates the configuration of a sheet manufacturing apparatus according to a second embodiment of the invention.

FIG. 11 illustrates the configuration of a sheet manufacturing apparatus according to the second embodiment of the invention. In FIG. 11 the sheet forming unit 86A is indicated by the dot-dash line.

This embodiment and the first embodiment described above differ in the configuration of the sheet forming unit, and are otherwise the same. More specifically, the sheet forming unit 86A in this embodiment comprises a compression device 84, two heaters 81 and 82, and two flappers 88, 89 that switch between paths 1 and 2. The sheet forming unit 86 in the first embodiment described above has a compression device 84 and two heaters 81 and 82, but does not have flappers that switch the conveyance path. This is the main difference between this embodiment and the first embodiment.

A sheet manufacturing apparatus 100A according to this embodiment is described next with reference to FIG. 11 and focusing on the differences with the first embodiment. Note that like parts in this and the first embodiment are identified by like reference numerals, and redundant description thereof is omitted.

As shown in FIG. 11, the sheet forming unit 86A in the sheet manufacturing apparatus 100A according to this embodiment comprises a compression device 84, two heaters 81 and 82, and two flappers 88, 89.

The first heater 81 has soft rollers (rollers 171A, 172A), and the second heater 82 has hard rollers (rollers 171B, 172B).

In FIG. 11, the bold solid line between flapper 88 and flapper 89 indicates a second web W2 or sheet S passing through the first path 1. In other words, in FIG. 11, the bold solid line between flapper 88 and flapper 89 indicates a first path 1.

When the flappers 88, 89 are set as indicated by the solid line in the figure, the first path 1 is selected, and the second web W2 is conveyed through the first path 1 and is heated by the first heater 81.

In FIG. 11, the bold dotted line between flapper 88 and flapper 89 indicates a second web W2 or sheet S passing through the second path 2. In other words, in FIG. 11, the bold dotted line between flapper 88 and flapper 89 indicates a second path 2.

When the flappers 88, 89 are set as indicated by the dotted line in the figure, the second path 2 is selected, and the second web W2 is conveyed through the second path 2 and is heated by the second heater 82.

The sheet manufacturing apparatus 100A according to this embodiment thus has a first path 1 on which the second web W2 is heated by the first heater 81 while being conveyed, and a second path 2 on which the second web W2 is heated by the second heater 82 while being conveyed, and the first path 1 and second path 2 can be selected by operating the flappers 88, 89.

When configured with a first path 1 on which the second web W2 is heated by the first heater 81 while being conveyed, and a second path 2 on which the second web W2 is heated by the second heater 82 while being conveyed, and switching between the first path 1 and second path 2, this embodiment of the invention has the same effect as the first embodiment.

Furthermore, when configured with a first path 1 on which the second web W2 is heated by the first heater 81 while being conveyed, and a second path 2 on which the second web W2 is heated by the second heater 82 while being conveyed, and switching between the first path 1 and second path 2, if one of the two heaters 81 and 82 becomes unusable due to the service life of the heater 81, 82, for example, the other of the two heaters 81 and 82 can still be used, loss from the sheet manufacturing apparatus 100A being unable to produce sheets S is reduced, and the efficiency (productivity) of the sheet manufacturing apparatus 100 can be improved.

Furthermore, when configured with a first path 1 on which the second web W2 is heated by the first heater 81 while being conveyed, and a second path 2 on which the second web W2 is heated by the second heater 82 while being conveyed, and switching between the first path 1 and second path 2, a mode for heating the second web W2 using only the first heater 81, and a mode for heating the second web W2 using only the second heater 82, can be selected even if the moving mechanism 190 is omitted.

More specifically, the cost of the heaters 81 and 82 can be reduced by omitting the moving mechanism 190 from the heaters 81 and 82.

Embodiment 3

Figure 12:
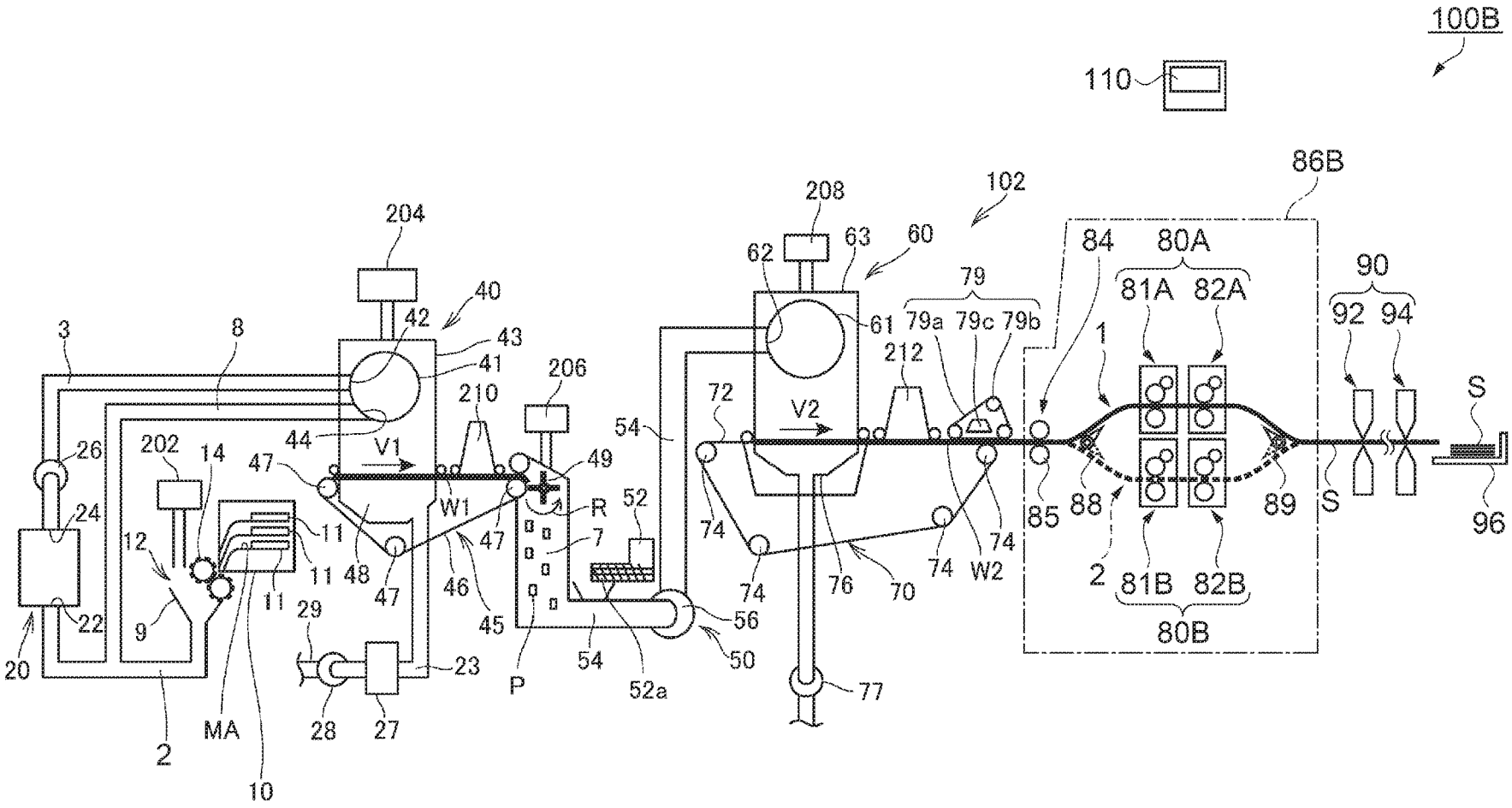
FIG. 12 schematically illustrates the configuration of a sheet manufacturing apparatus according to a third embodiment of the invention.

FIG. 12 illustrates the configuration of a sheet manufacturing apparatus according to the third embodiment of the invention. In FIG. 12 the sheet forming unit 86B is indicated by the dot-dash line.

This embodiment and the first embodiment described above differ in the configuration of the sheet forming unit, and are otherwise the same. More specifically, the sheet forming unit 86B in this embodiment comprises a compression device 84, two heater groups 80A, 80B, and two flappers 88, 89 that switch between paths 1 and 2. The sheet forming unit 86 in the first embodiment described above has a compression device 84 and one heater group 80, but does not have flappers that switch the conveyance path. This is the main difference between this embodiment and the first embodiment.

A sheet manufacturing apparatus 100B according to this embodiment is described next with reference to FIG. 12 and focusing on the differences with the first embodiment. Note that like parts in this and the first embodiment are identified by like reference numerals, and redundant description thereof is omitted.

As shown in FIG. 12, the sheet forming unit 86B in the sheet manufacturing apparatus 100B according to this embodiment comprises a compression device 84, two heater groups 80A, 80B, and two flappers 88, 89.

Heater group 80A has a first heater 81A and a second heater 82A. More specifically, heater group 80A has a first heater 81A with soft rollers (rollers 171A, 172A), and a second heater 82A with hard rollers (rollers 171B, 172B).

Heater group 80B has a first heater 81B and a second heater 82B. More specifically, heater group 80B has a first heater 81A with soft rollers (rollers 171A, 172A), and a second heater 82A with hard rollers (rollers 171B, 172B).

Two flappers 88, 89 are disposed at the opposite ends of the two heater groups 80A, 80B.

In FIG. 12, the bold solid line between flapper 88 and flapper 89 indicates a second web W2 or sheet S passing through the first path 1. In other words, in FIG. 11, the bold solid line between flapper 88 and flapper 89 indicates a first path 1.

When the flappers 88, 89 are set as indicated by the solid line in the figure, the first path 1 is selected, and the second web W2 is conveyed through the first path 1 and is heated by the heater group 80A. More specifically, the two heaters 81A, 82A are disposed to the first path 1, and the second web W2 is conveyed through the first path 1 and is heated by at least one of the two heaters 81A, 82A.

In FIG. 12, the bold dotted line between flapper 88 and flapper 89 indicates a second web W2 or sheet S passing through the second path 2. In other words, in FIG. 11, the bold dotted line between flapper 88 and flapper 89 indicates a second path 2.

When the flappers 88, 89 are set as indicated by the dotted line in the figure, the second path 2 is selected, and the second web W2 is conveyed through the first path 1 and is heated by the heater group 80B. More specifically, the two heaters 81B, 82B are disposed to the second path 2, and the second web W2 is conveyed through the second path 2 and is heated by at least one of the two heaters 81B, 82B.

The sheet manufacturing apparatus 100A according to this embodiment thus has a first path 1 on which the second web W2 is heated by heater group 80A while being conveyed, and a second path 2 on which the second web W2 is heated by heater group 80B while being conveyed, and the first path 1 and second path 2 can be selected by operating the flappers 88, 89.

Because the sheet manufacturing apparatus 100B according to this embodiment has four heaters 81A, 81B, 82A, 82B, the heating temperature can be set for four types of second webs W2. More specifically, because the sheet manufacturing apparatus 100B according to this embodiment can set the heating temperature for more types of second webs W2 than the sheet manufacturing apparatus 100 according to the first embodiment of the invention, condition changing loss due changing the heating temperature of the second web W2 can be further reduced, and the efficiency (productivity) of the sheet manufacturing apparatus 100B can be further improved.

Furthermore, when there are two heater groups 80A, 80B, and one of the two heater groups 80A, 80B cannot be used due to the service life of one of the heaters 81A, 81B, 82A, 82B, the other of the two heater groups 80A, 80B can still be used. As a result, condition changing loss due changing the heating temperature of the second web W2 can be further reduced, and the efficiency (productivity) of the sheet manufacturing apparatus 100B can be further improved.

Embodiment 4

Sheet Manufacturing System

Figure 13:
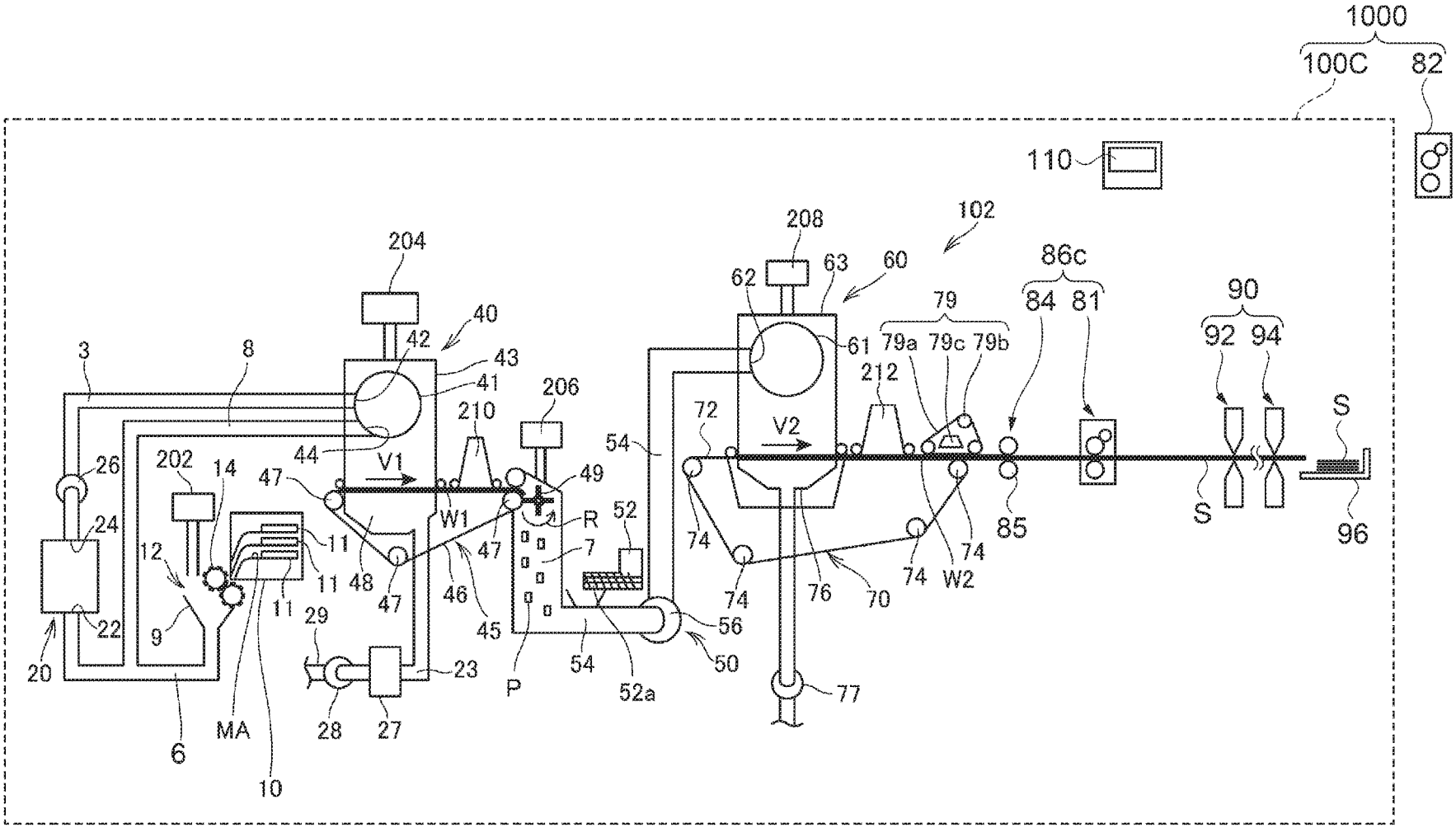
FIG. 13 schematically illustrates the configuration of a sheet manufacturing system according to a fourth embodiment of the invention.

FIG. 13 illustrates the configuration of a sheet manufacturing system according to a fourth embodiment of the invention. Note that in FIG. 13 the sheet manufacturing apparatus 100C is enclosed by a dotted line.

The sheet manufacturing system 1000 according to this embodiment includes a sheet manufacturing apparatus 100C and a second heater 82.

Note that the sheet manufacturing apparatus 100C is an example of an apparatus.

The sheet manufacturing apparatus 100C of the sheet manufacturing system 1000 according to this embodiment, and the sheet manufacturing apparatus 100 according to the first embodiment described above differ in the configuration of the sheet forming unit, and are otherwise the same. More specifically, the sheet forming unit 86C in this embodiment comprises a compression device 84 and one heater 81 (first heater 81). The sheet forming unit 86 in the first embodiment described above has a compression device 84 and two heaters 81 and 82 (first heater 81 and second heater 82). The configuration of the first heater 81 in this embodiment is the same as the first heater 81 in the first embodiment.

In other words, the sheet manufacturing apparatus 100C according to this embodiment is a sheet manufacturing apparatus that manufactures sheets S by heating, by a first heater 81, a mixture (second web W2) of fiber produced by defibrating feedstock MA and a binder, and the first heater 81 is configured as a unit that can be removably installed to the sheet manufacturing apparatus 100C.

The configuration of the second heater 82 of the sheet manufacturing system 1000 according to this embodiment is the same as the second heater 82 of the sheet manufacturing apparatus 100 according to the first embodiment of the invention, and is configured as a unit that can be removably installed to the sheet manufacturing apparatus 100C.

These are the main differences between this embodiment and the first embodiment of the invention.

A sheet manufacturing system 1000 according to this embodiment is described next with reference to FIG. 13 and focusing on the differences with the first embodiment. Note that like parts in this and the first embodiment are identified by like reference numerals, and redundant description thereof is omitted.

As shown in FIG. 13, the sheet manufacturing system 1000 according to this embodiment has a sheet manufacturing apparatus 100C, and a second heater 82 configured as a unit that can be removably installed to the sheet manufacturing apparatus 100C.

The first heater 81 disposed to the sheet manufacturing apparatus 100C comprises soft rollers with a soft body 185. Because the soft body 185 deforms according to the unevenness of the second web W2, the roller does not easily flatten the textured surface of the second web W2, and the sheet S formed by heating the second web W2 can be given a matte finish with suppressed luster.

The second heater 82 does not have a soft body 185, resists deformation following the textured surface of the second web W2, therefore flattens the unevenness in the surface of the second web W2, and in a sheet S formed by heating the second web W2, the textured surface of the second web W2 is flattened to a hard, shiny, glossy finish.

In other words, the specifications of the first heater 81 and second heater 82 differ in one or more of the heating conditions of the second web W2, compression conditions of the second web W2, and the quality or texture (such as a matte finish or glossy finish) of the manufactured sheet S.

Using the first heater 81 is preferable to make a sheet S with a textured, low luster, matte finish, and using the second heater 82 is therefore preferable to make a sheet S with a hard, high luster, glossy finish.

Note that the first heater 81 is an example of a first heater cassette, and the second heater 82 is an example of a second heater cassette.

To make a sheet S with a shiny, glossy finish in the sheet manufacturing apparatus 100C, the second heater 82 is preferable because it can more easily flatten the surface of the second web W2 than the first heater 81, which deforms according to the surface of the second web W2 and leaves a textured surface. As a result, the first heater 81 having soft rollers must be changed to the second heater 82 having hard rollers.

Because the components of the first heater 81 are unitized, the first heater 81 can be replaced (removably installed) as a single unit, and the first heater 81 can be more easily removed from the sheet manufacturing apparatus 100C than a configuration in which the components of the first heater 81 are not combined in a single unit. In addition, because the components of the second heater 82 are unitized, the second heater 82 can be replaced (removably installed) as a single unit, and the second heater 82 can be more easily installed in the sheet manufacturing apparatus 100C than a configuration in which the components of the second heater 82 are not configured as a single unit.

Therefore, in the sheet manufacturing apparatus 100C according to this embodiment, the first heater 81 can be easily replaced with the second heater 82, the time required to replace the first heater 81 with the second heater 82 is short, and loss from stopping processing by the manufacturing unit 102 to replace the first heater 81 with the second heater 82 can be reduced.

Furthermore, when the first heater 81 of the sheet manufacturing apparatus 100C is replaced with the second heater 82, and it is necessary to produce a sheet S with a low luster, matte finish, the second heater 82 must be replaced with the first heater 81, and the sheet manufacturing apparatus 100C returned to the initial state.

Because the components of the second heater 82 are unitized, the second heater 82 can be replaced (removably installed) as a single unit, and the second heater 82 can be more easily removed from the sheet manufacturing apparatus 100C than a configuration in which the components of the second heater 82 are not configured as a single unit. In addition, because the components of the first heater 81 are unitized, the first heater 81 can be replaced (removably installed) as a single unit, and the first heater 81 can be more easily installed in the sheet manufacturing apparatus 100C than a configuration in which the components of the first heater 81 are not configured as a single unit.

Therefore, in the sheet manufacturing apparatus 100C according to this embodiment, the second heater 82 can be easily replaced with the first heater 81, the time required to replace the second heater 82 with the first heater 81 is short, and loss from stopping processing by the manufacturing unit 102 to replace the second heater 82 with the first heater 81 can be reduced.

In this way, this embodiment of the invention shortens the down time of the sheet manufacturing apparatus 100C when exchanging the heaters 81 and 82, and the efficiency (productivity) of the sheet manufacturing apparatus 100C can be improved.

Sheet Manufacturing Method

Figure 14:
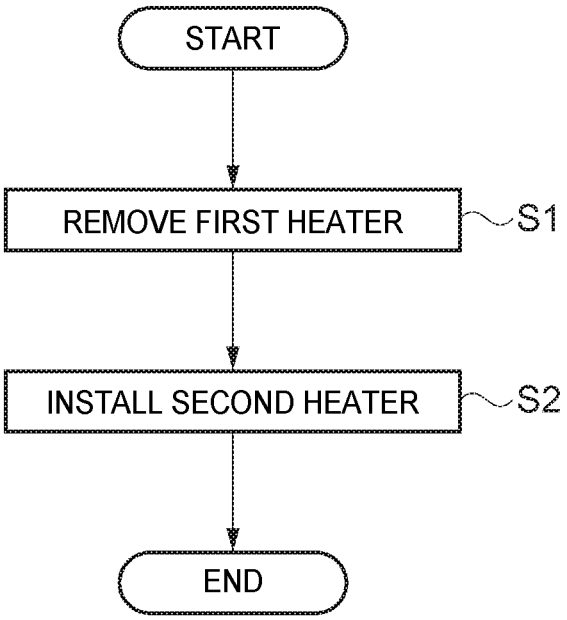
FIG. 14 is a flow chart of operations in the sheet manufacturing method according to the fourth embodiment of the invention.

FIG. 14 is a flow chart of the sheet manufacturing method according to this embodiment of the invention. FIG. 15 to FIG. 17 illustrate the operation in step S1 in FIG. 14.

Figure 15A:
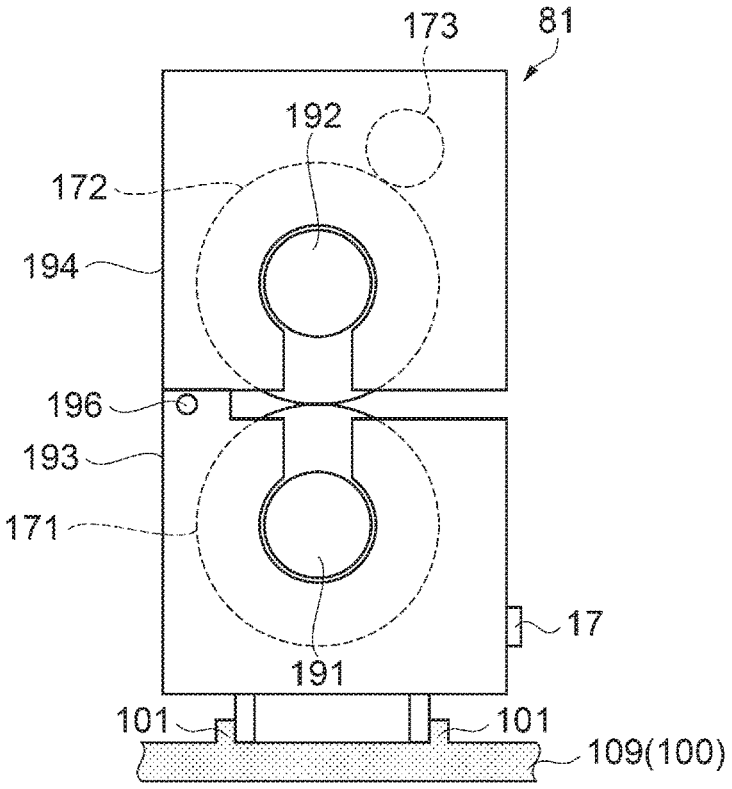
FIG. 15A schematically illustrates the state of step S1 in FIG. 14.
Figure 15B:
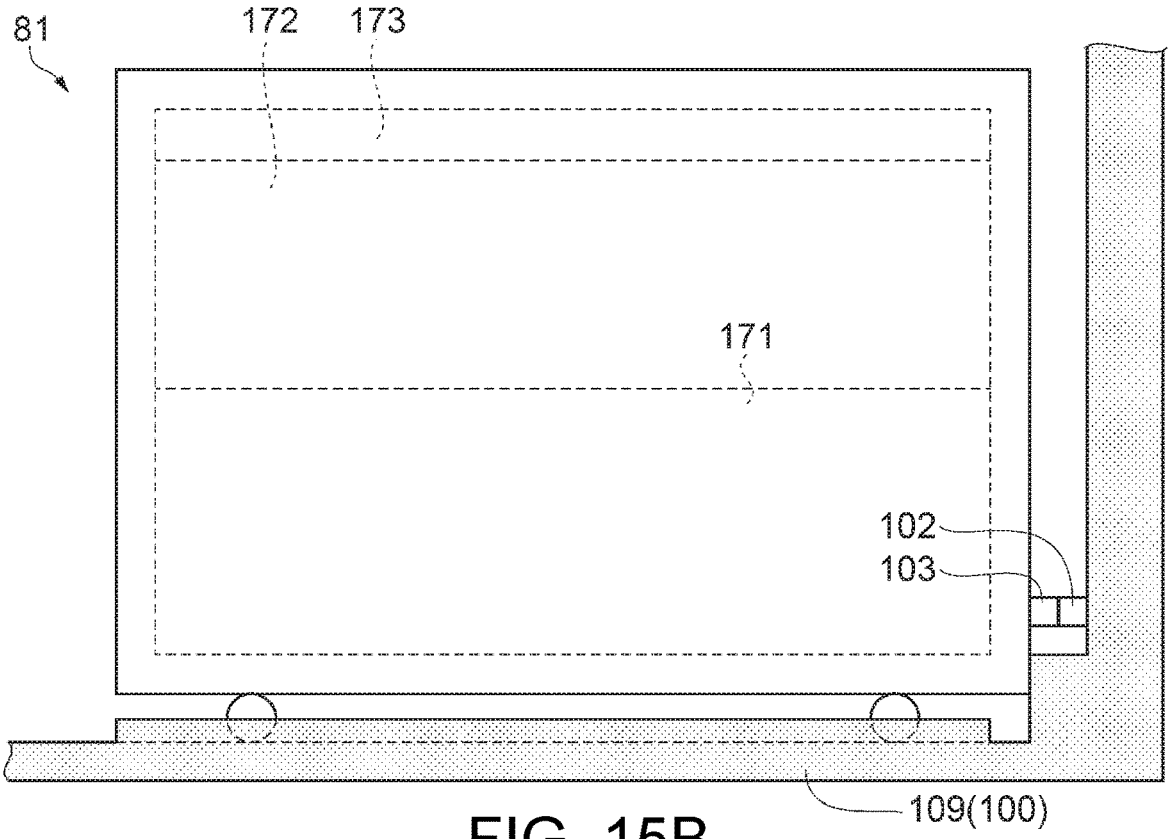
FIG. 15B schematically illustrates the state of step S1 in FIG. 14.
Figure 16A:
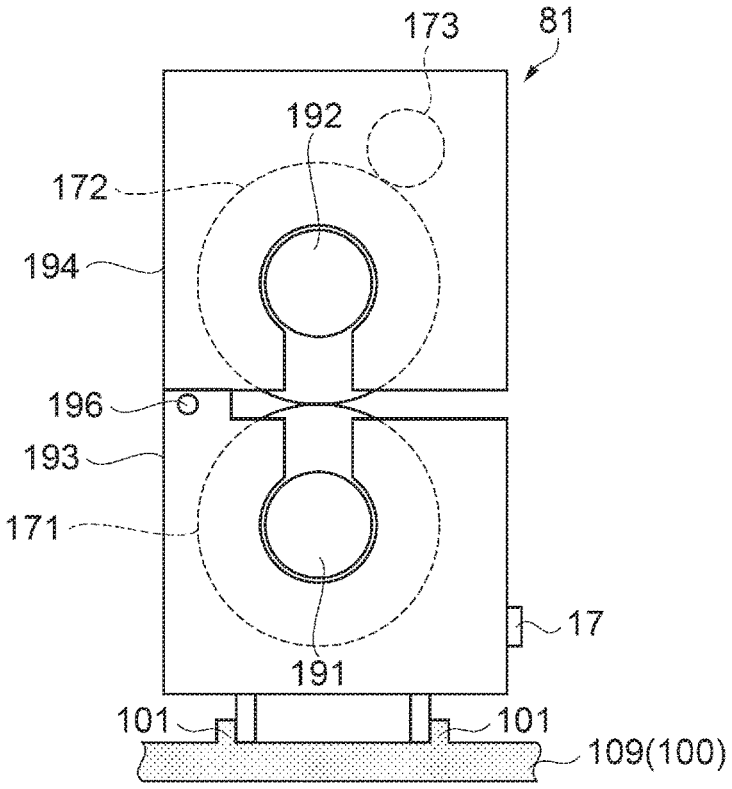
FIG. 16A schematically illustrates the state of step S1 in FIG. 14.
Figure 16B:
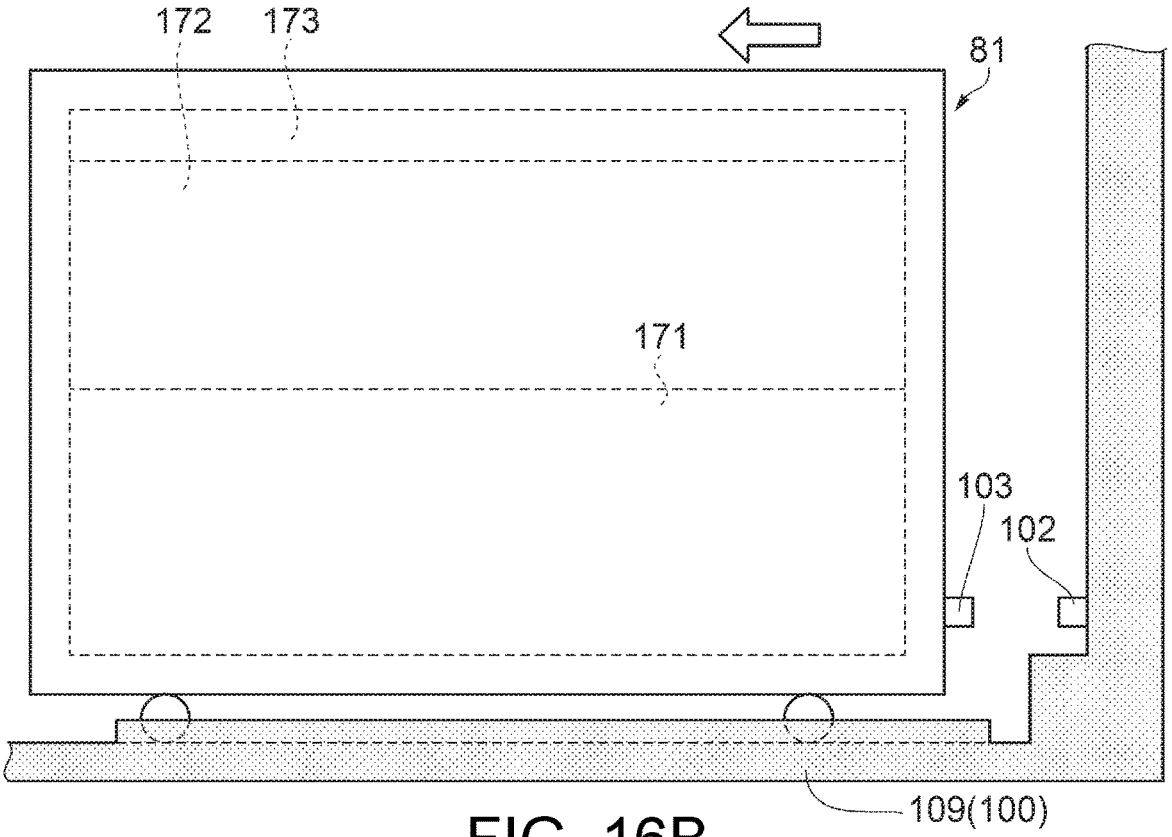
FIG. 16B schematically illustrates the state of step S1 in FIG. 14.
Figure 17A:
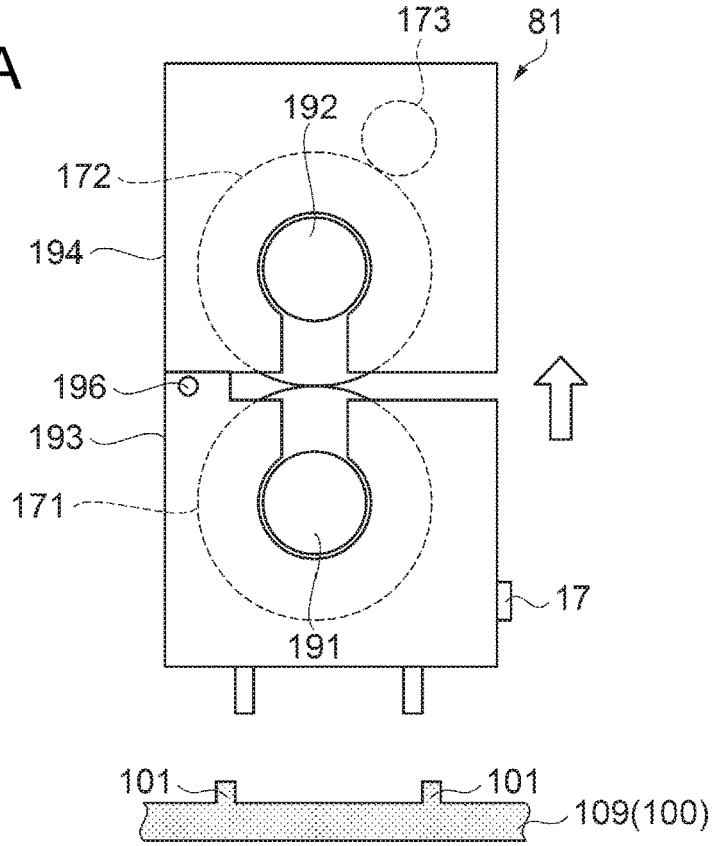
FIG. 17A schematically illustrates the state of step S1 in FIG. 14.
Figure 17B:
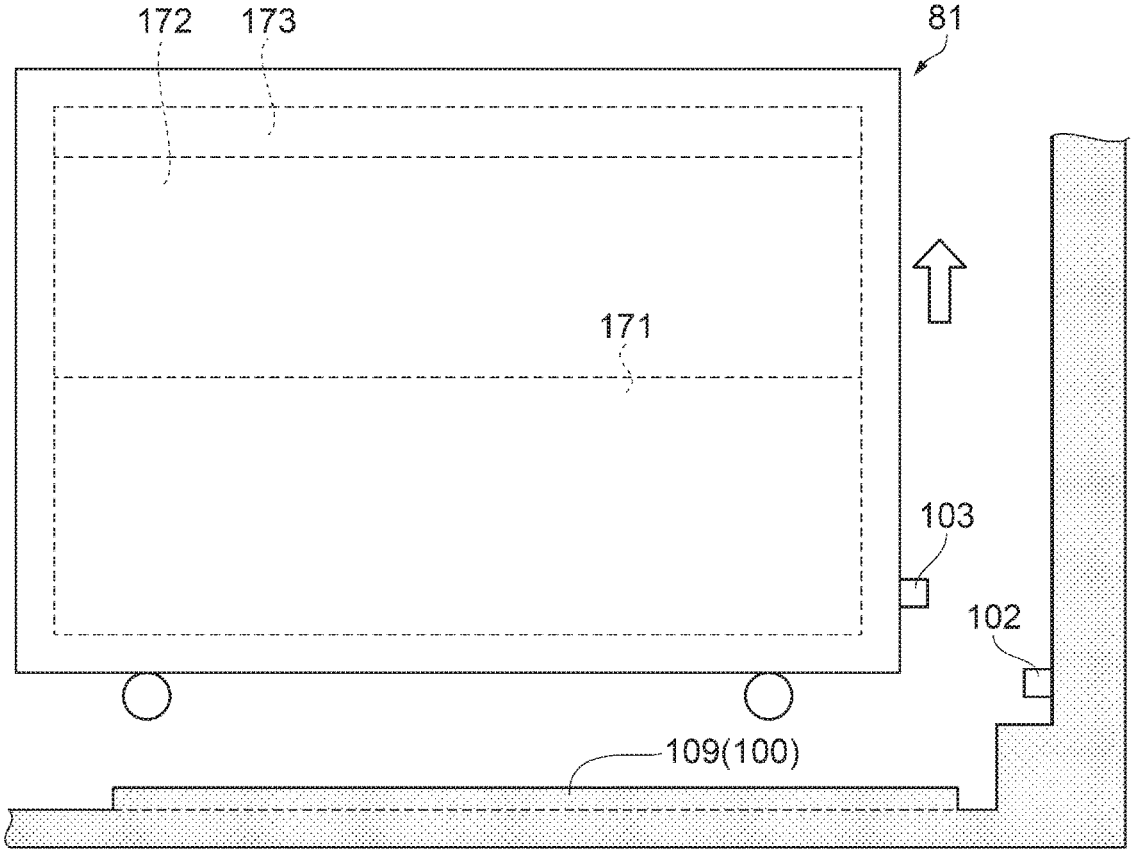
FIG. 17B schematically illustrates the state of step S1 in FIG. 14.

More specifically, FIG. 15 illustrates before the first heater 81 is removed. FIG. 16 and FIG. 17 illustrate removing the first heater 81. FIG. 15A, FIG. 16A, and FIG. 17A show the first heater 81 from the short side (from the direction perpendicular to the width of the sheet S), omitting parts of the moving mechanism 190 shown in FIG. 6. FIG. 15B, FIG. 16B, and FIG. 17B are views from the long side of the first heater 81 (from the width of the sheet S).

A sheet manufacturing method according to this embodiment is described next with reference to FIG. 14 to FIG. 17.

As shown in FIG. 14, the sheet manufacturing method according to this embodiment has a step (step S1) of removing the first heater 81 from the sheet manufacturing apparatus 100C, and a step (step S2) of installing the second heater 82 to the sheet manufacturing apparatus 100C.

Note that step S1 is an example of the process disconnecting the electrical connections and mechanical attachment of the first heater cassette to the sheet manufacturing apparatus. Step S2 is an example of the process of making the electrical connections and mechanical attaching the second heater cassette to the sheet manufacturing apparatus in place of the first heater cassette.

Of the type of feedstock MA, type of sheet S, and sheet S production speed in the input information stored in the storage 130 of the sheet manufacturing apparatus 100C, at least one can be selectively set.

Based on the first information, second information, and input information, the controller 120 determines the heating temperature of the second web W2, and selects the heater 81, 82 best suited to heating the second web W2.

As described above, the sheet S production speed, sheet S color, sheet S type, and feedstock MA type selected through the operating panel 140 are stored as input information in the storage 130 of the controller 120. The controller 120 selects the heater 81, 82 preferable for heating the second web W2, and displays the preferred heater 81, 82 in the message pane 164 of the operating screen 160. The operator than installs the preferred heater 81, 82 based on the content displayed in the message pane 164 of the operating screen 160.

In other words, either the step (step S1) of removing the first heater 81 from the sheet manufacturing apparatus 100C, or the step (step S2) of installing the second heater 82 in place of the first heater 81 to the sheet manufacturing apparatus 100C, is executed according to the settings of the input information in the sheet manufacturing apparatus 100C.

In the following example, the operator replaces the first heater 81 with the second heater 82 according to the content displayed in the message pane 164 of the operating screen 160.

In step S1, the operator disconnects the electrical connections and mechanical attachment in the sheet manufacturing apparatus 100C, and removes the first heater 81 from the sheet manufacturing apparatus 100C.

As shown in FIG. 15A and FIG. 15B, first fasteners 101 and second fasteners 102 are disposed to the chassis 109 of the sheet manufacturing apparatus 100C. As shown in FIG. 15A, the first fasteners 101 are disposed so that the two casters 175 of the first heater 81 are therebetween, suppressing movement of the first heater 81 in the short direction. In other words, the first fasteners 101 control the position of the first heater 81 in the short direction.

As shown in FIG. 15B, the second fastener 102 is disposed to contact one long end of the first heater 81. On one long end of the first heater 81 is disposed a third fastener 103 to contact the second fastener 102.

Disposed to the second fastener 102 and third fastener 103 are electrodes (not shown in the figure) for electrically connecting the first heater 81 (circuit board 17) and sheet manufacturing apparatus 100C (controller 120), and fasteners (not shown in the figure) for mechanically securing the first heater 81 to the sheet manufacturing apparatus 100C (chassis 109). In other words, by connecting the second fastener 102 and third fastener 103, the first heater 81 and sheet manufacturing apparatus 100C are electrically connected and mechanically secured.

The configuration for connecting the first heater 81 and the sheet manufacturing apparatus 100C, and the configuration for connecting the second heater 82 and the sheet manufacturing apparatus 100C, are identical. While not shown in the figures, the second heater 82 electrically connects to the sheet manufacturing apparatus 100C (controller 120), and is mechanically secured to the sheet manufacturing apparatus 100C (chassis 109) in the same way as the first heater 81.

As shown in FIG. 16B, in step S1, the first heater 81 is moved in the direction of the arrow in the figure, separating the second fastener 102 and third fastener 103, electrically disconnecting the first heater 81 and sheet manufacturing apparatus 100C, and mechanically disengaging the first heater 81 and sheet manufacturing apparatus 100C. As shown in FIG. 16A, because movement of the first heater 81 in the short direction is prevented by the first fastener 101 at this time, the position of the first heater 81 in the first direction does not change.

Also in step S1, as shown in FIG. 17A and FIG. 17B, the first heater 81 is moved in the direction of the arrow in the figure, separating the first heater 81 from the chassis 109 of the sheet manufacturing apparatus 100C, and removing the first heater 81 from the chassis 109 of the sheet manufacturing apparatus 100C.

More specifically, sequentially through the states shown in FIG. 15, FIG. 16, and FIG. 17 in step S1, the first heater 81 and sheet manufacturing apparatus 100C are electrically disconnected, and the first heater 81 and sheet manufacturing apparatus 100C are mechanically disengaged.

To install the first heater 81 to the chassis 109 of the sheet manufacturing apparatus 100C, the first heater 81 and sheet manufacturing apparatus 100C are electrically connected, and the first heater 81 and sheet manufacturing apparatus 100C are mechanically engaged, and the first heater 81 is installed to the chassis 109 of the sheet manufacturing apparatus 100C sequentially through the states shown in FIG. 17, FIG. 16, and FIG. 15.

In step S2, the second heater 82 is electrically connected to the sheet manufacturing apparatus 100C, and the second heater 82 is mechanically secured to the sheet manufacturing apparatus 100C (chassis 109).

The configuration for connecting the first heater 81 and sheet manufacturing apparatus 100C, and the configuration for connecting the second heater 82 and sheet manufacturing apparatus 100C, are identical. As a result, through the states shown in FIG. 17, FIG. 16, and FIG. 15, the second heater 82 can be installed to the chassis 109 of the sheet manufacturing apparatus 100C by the same procedure used to install the first heater 81 to the chassis 109 of the sheet manufacturing apparatus 100C.

In other words, in step S2, the second heater 82 is electrically connected and mechanically secured to the sheet manufacturing apparatus 100C instead of the first heater 81, and is thereby installed to the sheet manufacturing apparatus 100C.

Because the components of the first heater 81 are unitized, the first heater 81 can be replaced (removably installed) as a single unit, and the first heater 81 can be more easily removed from the sheet manufacturing apparatus 100C than a configuration in which the components of the first heater 81 are not combined in a single unit. In addition, because the components of the second heater 82 are unitized, the second heater 82 can be replaced (removably installed) as a single unit, and the second heater 82 can be more easily installed in the sheet manufacturing apparatus 100C than a configuration in which the components of the second heater 82 are not configured as a single unit.

Therefore, the time required for step S1 and step S2, that is, the time during which the sheet manufacturing apparatus 100C cannot manufacture sheets S because of step S1 and step S2, is short. The down time of the sheet manufacturing apparatus 100C is therefore short, and the efficiency (productivity) of the sheet manufacturing apparatus 100C can be improved.

The invention is not limited to the foregoing embodiments, can be varied in many ways without departing from the scope and concept of the invention as will be understood from the accompanying claims and foregoing description, and various modifications of the foregoing embodiments are conceivable. Examples of some variations are described below.

Variation 1

In the first embodiment, the number of heaters available to heat the second web W2 compressed by the compression device 84 is two. However, the number of heaters used to heat the second web W2 compressed by the compression device 84 is not limited to two, and there may be one or more than two.

For example, even if only one heater is used to heat the second web W2 compressed by the compression device 84, if the components of the heater are configured as a single unit, the time required to replace the heater is shorter than with a configuration requiring disassembling the heater and replacing only the parts (components) that have deteriorated. Down time accompanying heater replacement is therefore short, and the efficiency (productivity) of the sheet manufacturing apparatus 100 can be improved.

Therefore, even if the number of heaters used to heat the second web W2 is one, a configuration incorporating the elements of the heater in a single unit is within the technical scope of the invention.

Variation 2

In the first embodiment the components of the heaters 81 and 82 are configured into a single unit and the heaters 81 and 82 can be replaced as a single unit, but a configuration having two heaters that are difficult to exchange as single units because the components not combined in a single unit is also conceivable.

If there are two heaters, and the heating temperature of one of the two heaters is changed while the other of the two heaters is heating the second web W2, the condition changing loss accompanying changing the heating temperature of the heater can be reduced.

A configuration enabling setting multiple heater temperatures even though the heaters are not configured with the components in a single unit and are therefore difficult to exchange is also within the technical scope of the invention.

Variation 3

In the first and second embodiments, the heater group 80 has a first heater 81 with soft rollers (rollers 171A, 172A), and a second heater 82 with hard rollers (rollers 171B, 172B), but the invention is not so limited.

For example, the heater group 80 may be a configuration having a first heater 81 with soft rollers (rollers 171A, 172A), and another first heater 81 with soft rollers (rollers 171A, 172A). In another example, the heater group 80 may be a configuration having a second heater 82 with hard rollers (rollers 171B, 172B), and another second heater 82 with hard rollers (rollers 171B, 172B).

Furthermore, in the third embodiment, first heaters 81A, 81B having soft rollers (rollers 171A, 172A), and second heaters 82A, 82B having hard rollers (rollers 171B, 172B), are disposed to the heater groups 80A, 80B, but the invention is not so limited.

For example, a first heater 81A with soft rollers (rollers 171A, 172A), and a first heater 81B with soft rollers (rollers 171B, 172B), may be disposed to the heater group 80A, and a second heater 82A with hard rollers (rollers 171B, 172B), and second heater 82B with hard rollers (rollers 171B, 172B), may be disposed to heater group 80B.

Variation 4

In the first embodiment, the soft rollers (rollers 171A, 172A) are heating rollers with an internal heat source H. However, the soft rollers (rollers 171A, 172A) may be configured without an internal heat source H, and the outside surface heated by another heat roller (such as third roller 173). More specifically, the soft rollers having a soft body 185 may be configured without an internal heat source with the outside surface of the soft roller heated by another heat roller.

If only the outside surface of the soft roller is heated by a heat roller, thermal degradation of the soft body 185 is more difficult than a configuration that heats the entire soft roller by means of an internal heat source H, and the service life of the soft roller can be increases.

Variation 5

In the fourth embodiment, the number of heaters (first heater 81) disposed to the sheet manufacturing apparatus 100C is not limited to one, and there may be more than one. For example, as in the first embodiment and the second embodiment, the number of heaters disposed to the sheet manufacturing apparatus 100C may be two, or four as in the third embodiment. For example, the sheet manufacturing apparatus 100C in the fourth embodiment may be the sheet manufacturing apparatus 100 (see FIG. 1) according to the first embodiment of the invention, the sheet manufacturing apparatus 100A (see FIG. 11) according to the second embodiment of the invention, or the sheet manufacturing apparatus 100B (see FIG. 12) according to the third embodiment of the invention.

Furthermore, the number of heaters (second heater 82) in the sheet manufacturing system 1000, that is, the number of heaters (second heater 82) removably installable to the sheet manufacturing apparatus 100C, is not limited to one, and may be more than one. By increasing the number of heaters removably installable to the sheet manufacturing apparatus 100C, the variety of sheets S that can be made by the sheet manufacturing system 1000 can be increased. More specifically, if the number of heaters (types of heaters) removably installable to the sheet manufacturing apparatus is increased in a sheet manufacturing system that makes sheets by using a heater disposed to a sheet manufacturing apparatus to heat a mixture of a binder and fiber produced defibrating feedstock, a wide range of sheets S of different quality and texture (matte finish, glossy finish, for example) can be made.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2017-166555, filed Aug. 31, 2017 is expressly incorporated by reference herein.

What is claimed is:

1. A sheet manufacturing apparatus for making a sheet and comprising:

a heater configured to heat a mixture of a binder and fiber produced by defibrating feedstock, wherein:

the heater is a single, discrete unit that can be removed from the sheet manufacturing apparatus; and the heater has a first storage that readably stores first information.

2. The sheet manufacturing apparatus described in claim 1, wherein:

the heater is configured with:

a first roller, a second roller, which is disposed to hold the mixture between the first roller and the second roller, and a moving mechanism, which is configured to switch between (i) a position in which the mixture is held between the first roller and the second roller, and (ii) a position where the first roller and the second roller are separated and not holding the mixture therebetween.

3. The sheet manufacturing apparatus described in claim 1, wherein:

the heater is configured as a removably installable unit and includes a first heater and a second heater, which is configured to heat the mixture under a different condition than the first heater.

4. The sheet manufacturing apparatus described in claim 3, wherein:

the different condition is a heating condition of the mixture, a compression condition of the mixture, or a material of a first roller or a second roller of the heater.

5. The sheet manufacturing apparatus described in claim 3, wherein:

the first heater and the second heater are disposed to a conveyance path of the mixture in an upstream and downstream relationship; and the mixture is heated by at least one of the first heater and the second heater.

6. The sheet manufacturing apparatus described in claim 1, wherein:

the first information includes a cumulative total of sequentially added products of an operating time of the heater and an operating temperature of the heater; and the cumulative total includes (i) a warning value, which warns that a state in which the heater cannot be used appropriately is approaching, and (ii) a usable limit value, which is a maximum value at which the heater can be used appropriately.

7. The sheet manufacturing apparatus described in claim 6, further comprising:

a controller, the controller (i) calculating a new product each time the heater operates, (ii) calculating a new total adding the new product to a previous total, (iii) storing the new total in the first storage, and (iv) when the new total exceeds the warning value, prompting replacement of the heater.

8. The sheet manufacturing apparatus described in claim 6, further comprising:

a controller, the controller (i) calculating a new product each time the heater operates, (ii) calculating a new total adding the new product to a previous total, (iii) storing the new total in the first storage, and (iv) when the new total exceeds the warning value, turning the heater off.

9. The sheet manufacturing apparatus described in claim 1, further comprising:

a binder supply device individually storing different types of binders; and a second storage disposed to the binder supply device and storing second information readably, wherein the second information includes at least one of a type of binder and a heating temperature linked to the type of binder.

10. The sheet manufacturing apparatus described in claim 9, further comprising:

a controller, the controller determining the heating temperature of the heater based on the first information, the second information, and input information including a type of feedstock, a type of sheet, and sheet production speed, wherein:

the heater includes a first heater and a second heater, which is configured to heat the mixture under a different condition than the first heater, and the controller is configured to cause the sheet manufacturing apparatus to heat the mixture using the first heater, or the second heater, or the first heater and the second heater.

11. A sheet manufacturing apparatus for making a sheet and comprising:

a heater configured to heat a mixture of a binder and fiber produced by defibrating feedstock, wherein:

the heater is a single, discrete unit that can be removed from the sheet manufacturing apparatus;

the heater is configured as a removably installable unit and includes a first heater and a second heater, which is configured to heat the mixture under a different condition than the first heater;

the sheet manufacturing apparatus further comprises (i) a first path where the mixture is heated by the first heater while being conveyed and (ii) a second path where the mixture is heated by the second heater while being conveyed; and the first path and the second path are selectable.

* * * * *